US009352386B2

(12) United States Patent
Guastini et al.

(10) Patent No.: US 9,352,386 B2
(45) **Date of Patent: *May 31, 2016**

(54) PROCESS AND APPARATUS FOR CONTROLLING THE FLOWS OF LIQUID METAL IN A CRYSTALLIZER FOR THE CONTINUOUS CASTING OF THIN FLAT SLABS

(71) Applicant: DANIELI & C. OFFICINE MECCANICHE S.P.A., Buttrio (IT)

(72) Inventors: Fabio Guastini, Dolegna Del Collio (IT); Andrea Codutti, Moruzzo Fraz. Brazzacco (IT); Michele Minen, Udine (IT); Fabio Vecchiet, Cervignano Del Friuli (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

This patent is subject to a terminal disclaimer.

(21) Appl. No.: 14/845,021

(22) Filed: Sep. 3, 2015

(65) Prior Publication Data

US 2015/0375295 A1 Dec. 31, 2015

Related U.S. Application Data

(62) Division of application No. 13/814,465, filed as application No. PCT/EP2011/063448 on Aug. 4, 2011, now Pat. No. 9,156,084.

(30) Foreign Application Priority Data

Aug. 5, 2010 (IT) ..... MI2010A1500

(51) Int. Cl.
*B22D 11/11* (2006.01)
*B22D 11/115* (2006.01)

(52) U.S. Cl.
CPC ..... *B22D 11/11* (2013.01); *B22D 11/115* (2013.01)

(58) Field of Classification Search
CPC ..... B22D 11/10; B22D 11/11; B22D 11/114; B22D 11/115; B22D 27/00; B22D 27/02
See application file for complete search history.

(56) References Cited

U.S. PATENT DOCUMENTS

| | | | |
|---|---|---|---|
| 6,164,365 | A | 12/2000 | Kunstreich et al. |
| 6,253,832 | B1 | 7/2001 | Hallefalt |

FOREIGN PATENT DOCUMENTS

| | | |
|---|---|---|
| CN | 87104014 | 12/1988 |
| CN | 2865934 | 2/2007 |
| FR | 2442294 | 6/1999 |
| JP | 61206650 | 9/1986 |
| JP | 08010917 | 1/1996 |

OTHER PUBLICATIONS

International Search Report and Written Opinion for International Application No. PCT/EP2011/063448; 6 pgs.

*Primary Examiner* — Kevin P Kerns
*Assistant Examiner* — Steven Ha
(74) *Attorney, Agent, or Firm* — Stetina Brunda Garred & Brucker

(57) ABSTRACT

The present invention relates to a process for controlling the distribution of liquid metal flows of in a crystallizer for the continuous casting of thin slabs. In particular, the process applies to a crystallizer comprising perimetral walls which define a containment volume for a liquid metal bath insertable through a discharger placed in the middle of the bath. The process includes arranging a plurality of electromagnetic brakes, each for generating a braking zone within said bath, and activating these electromagnetic brakes either independently or in groups according to characteristic parameters of the fluid-dynamic conditions of the liquid metal within the bath.

11 Claims, 13 Drawing Sheets

PROCESS AND APPARATUS FOR CONTROLLING THE FLOWS OF LIQUID METAL IN A CRYSTALLIZER FOR THE CONTINUOUS CASTING OF THIN FLAT SLABS

CROSS-REFERENCE TO RELATED APPLICATIONS

This application is a divisional of U.S. patent application Ser. No. 13/814,465 filed on Feb. 5, 2013, which claims priority to PCT International Application No. PCT/EP2011/063448 filed on Aug. 4, 2011, which application claims priority to Italian Patent Application No. MI2010A001500 filed Aug. 5, 2010, the entirety of the disclosures of which are expressly incorporated herein by reference.

FIELD OF THE INVENTION

The present invention relates to the field of continuous casting processes for producing metal bodies. In particular, the invention relates to a process for controlling the distribution of liquid metal flows in a crystallizer for continuously casting thin slabs. The invention further relates to an apparatus for implementing such a process.

STATE OF THE ART

As known, the continuous casting technique is widely used for the production of metal bodies of various shapes and sizes, including thin steel slabs less than 150 mm thick. With reference to FIG. 1, the continuous casting of these semi-finished products includes using a copper crystallizer 1 which defines a volume for a liquid metal bath 4. Such a volume normally comprises a central basin for the introduction of a discharger 3 with a relatively large section as compared to the liquid bath, in order to minimize the speed of the introduced steel.

It is equally known that in this type of casting, obtaining an optimal distribution of the fluid in the crystallizer is fundamental in order to cast at high speed (e.g. higher than 4.5 m/min), and thus ensure high productivity rates. A correct fluid distribution is further needed to ensure correct lubrication of the cast by means of molten powders and avoid risks of "sticking", i.e. risks of breaking the skin layer 22 which solidifies on the inner walls of the crystallizer up to the possible disastrous leakage of the liquid metal from the crystallizer ("break-out"), which causes the casting line to stop. As known, possible sticking phenomena strongly deteriorates the quality of the semi-finished product.

As described in U.S. Pat. No. 6,464,154, for example, and shown in FIG. 1, most dischargers for introducing liquid metal into the crystallizer are configured to generate two central jets 5, 5' of liquid steel directed downwards and two secondary recirculations 6, 6' directed towards the bath surface 7, also called meniscus, which is generally covered with a layer of various oxide-based casting powders, which melt and protect the surface itself from oxidation. The liquefied part of such a powder layer, by being introduced between the inner surface of the copper wall of the crystallizer and the skin layer, also promotes cast lubrication. In order to obtain excellent internal fluid-dynamics, the need is known to obtain maximum speeds of the liquid metal averagely lower than about 0.5 m/sec at the meniscus 7, to avoid entrapments of casting powder in either solid or liquid phase, which would cause faults on the final product. These speeds should not however be lower than about 0.08 m/sec to avoid the formation of "cold spots" which would not allow the powder to melt, thus creating possible solidification bridges, especially between the discharger and the crystallizer walls, and incorrect melting of the powder layer, with a consequent insufficient lubrication of the cast. This would obviously determine evident problems of castability. In addition to these limitations concerning speed, the further need is known to contain the waviness of the liquid metal in proximity of the meniscus, mainly caused by the secondary recirculations 6, 6'. Such a waviness should preferably have a maximum instantaneous width lower than 15 mm and an average width lower than 10 mm in order to avoid defects in the finished product caused by the incorporation of powder as well as difficulties in the cast lubrication through the molten powder. The latter condition could even cause break-out phenomena. These optimal casting parameters may be observed on the meniscus surface through the normal continuous casting methods and devices.

The control of liquid metal flows in the crystallizer is therefore of primary importance in the continuous casting process. With this regard, the dischargers used have an optimized geometry for controlling the flow usually over a certain range of flow rates and for a predetermined crystallizer size. Beyond these conditions, the crystallizers do not allow correct fluid-dynamics under all the multiple casting conditions which may occur. For example, in case of high flow rates, the downward jets 5, 5' and the upward recirculations 6, 6' may be excessively intense, thus causing high speeds and non-optimal waviness of meniscus 7. On the contrary, in case of low flow rates, the upward recirculations 6, 6' could be too weak, thus determining castability problems.

Under a further casting condition, diagrammatically shown in FIG. 1A, the discharger could be incorrectly introduced and therefore the flow rate of liquid metal is asymmetric or, for example, due to the presence of partial asymmetric occlusions due to the oxides which accumulate on the inner walls of the dischargers, the flow rate is asymmetric. Under these conditions, the speed and flow rate of the flows directed towards a first half of the liquid bath are different from those of the flows directed towards the other half. This dangerous situation may lead to the formation of stationary waves which obstruct the correct casting of the powder layer at the meniscus, thus causing entrapment phenomena with detrimental consequences for the cast quality, and even break-out phenomena due to an incorrect lubrication.

Various methods and devices have been developed to improve the fluid-dynamic distribution in the liquid metal bath, which at least partially solve this problem in connection however to the casting of conventional slabs thicker than 150 mm only. A first type of these methods includes, for example, the use of linear motors, the magnetic field of which is used to brake and/or accelerate the inner flows of the molten metal. It has however been observed that using linear motors is not very effective for continuously casting thin slabs, in which the copper plates which normally define the crystallizer are more than two times thicker than conventional slabs, thus acting as a shield against the penetration of alternating magnetic fields produced by the liner motors, thus making them rather ineffective for producing braking forces in the liquid metal bath.

A second type of methods includes using dc electromagnetic brakes, which are normally configured to brake and control the inner distribution of liquid metal exclusively in the presence of a precise fluid-dynamic condition. In the case of the solution described in U.S. Pat. No. 6,557,623 B2, for example, using an electromagnetic brake is useful to slow down the flow only in the presence of high flow rates. The device described in patent application JP4344858 allows instead to slow down the liquid metal in the presence of both high and low flow rates, but does not allow to correct possible asymmetries. Some devices, such as for example that described in application EP09030946, allow to correct the possible flow asymmetry (diagrammatically shown in FIG. 1A) but are totally ineffective if the casting occurs at low flow rates.

The device described in application FR 2772294 provides the use of electromagnetic brakes which typically have the form of two or three phase linear motors. In particular, such brakes consist of a ferromagnetic material casing (yoke) in form of plate, which defines cavities inside which current conductors supplied, contrary to ordinary practice, by direct current, are accommodated. The ferromagnetic casing (yoke) is installed in position adjacent to the walls of the crystallizer so that the conductors supplied by direct current generate a static magnetic field that the inventor asserts to be able to move within the liquid metal bath exclusively by supplying the various current conductors in differentiated manner.

However, it has been seen that this technical solution is not efficient because the magnetic flux generated by the conductors, via the path of lesser reluctance necessarily closes towards the ferromagnetic casing (yoke) thus crossing the liquid bath again. This condition disadvantageously creates undesired braking zones in the liquid metal bath. In other words, with the solution described in FR 2772294, it is not possible to obtain a braking zone concentrated in a single region but, on the contrary, the magnetic field generated by the conductors is substantially re-distributed in most of the metal liquid bath thus resulting locally more or less intense.

Another drawback, closely connected to the one indicated above, concerning the solution described in FR 2772294 and solutions of similar concept, relates to the impossibility of differentiating braking zones within the liquid metal bath in terms of extension and geometric conformation. This drawback is mainly due to the fact that the conductors all display the same geometric section and in that the ferromagnetic casing (yoke) which contains it has a rectangular, and in all cases regular shape.

Thus, summarizing the above, by means of the solution described in FR 2772294, it is not only impossible to obtain, in the liquid metal bath, specific completely isolated braking zones, i.e. surrounded by a region in which the magnetic field does not act but it is also impossible to geometrically differentiate such specific braking zones. These have the same geometric conformation, i.e. the same extension in space.

Japanese patent JP61206550A indicates the use of electromagnetic force generators to reduce the oscillation of the waves at the meniscus of the metal material bath. Such generators are activated by means of a control system which activates it as a function of the width of the waves/oscillations so as to limit the same. Being an active control system, the applied current is not constant for a specific casting situation but on the contrary will vary continuously as a function of waviness. Due to this continuous current variability, the solution described in JP61206550A does not allow an effective control of the inner regions of the liquid metal bath, i.e. relatively distanced from the meniscus.

SUMMARY

It is the main object of the present invention to provide a process for controlling the flows of liquid metal in a crystallizer for continuously casting thin slabs which allows to overcome the above-mentioned drawbacks. Within the scope of this task, it is an object of the present invention to provide a process which is operatively flexible, i.e. which allows to control the flows of liquid metal under the various fluid-dynamic conditions which may develop during the casting process. It is another object to provide a process which is reliable and easy to be implemented at competitive costs.

The present invention thus relates to a process for controlling the flows of liquid metal in a crystallizer for continuously casting thin slabs as disclosed in claim 1. In particular, the process applies to a crystallizer comprising perimetral walls which define a containment volume for a liquid metal bath insertable through a discharger arranged centrally in said bath. The process includes generating a plurality of braking zones of the flows of said liquid metal within said bath, each through an electromagnetic brake. In particular, the following are included:

- a first electromagnetic brake for generating a first braking zone in a central portion of the bath in proximity of an outlet section of the liquid metal from the discharger, the central portion being delimited between two perimetral front walls of said crystallizer;
- a second electromagnetic brake for generating a second braking zone in a central portion of the bath in a position mainly underneath the first braking zone;
- a third electromagnetic brake for generating a third braking zone in a first side portion of the bath between said central portion and a first perimetral sidewall substantially orthogonal to said front walls;
- a fourth electromagnetic brake for generating a fourth braking zone within a second side portion of the liquid metal bath, which is symmetric to the first side portion with respect to a symmetry plane substantially orthogonal to the front perimetral walls of the crystallizer;
- a fifth electromagnetic brake for generating a fifth braking zone in the first side portion of the bath in a position mainly underneath said third braking zone;
- a sixth electromagnetic brake for generating a sixth braking zone in said second side portion of said bath in a position mainly underneath said fourth braking zone.

The process includes activating said braking zones either independently or in groups, according to characteristic parameters of the fluid-dynamic conditions of the liquid metal in said bath.

The present invention also relates to an apparatus for controlling the flows of liquid metal in a crystallizer for continuously casting thin slabs, which allows to implement the process according to the present invention.

BRIEF DESCRIPTION OF THE FIGURES

Further features and advantages of the present invention will be apparent in the light of the detailed description of preferred, but not exclusive, embodiments of a crystallizer to which the process according to the invention applies and an apparatus comprising such a crystallizer, illustrated by the way of non-limitative example, with the aid of the accompanying drawings, in which.

The same reference numbers and letters in the figures refer to the same elements or components.

DETAILED DESCRIPTION OF THE INVENTION

Figure 1:
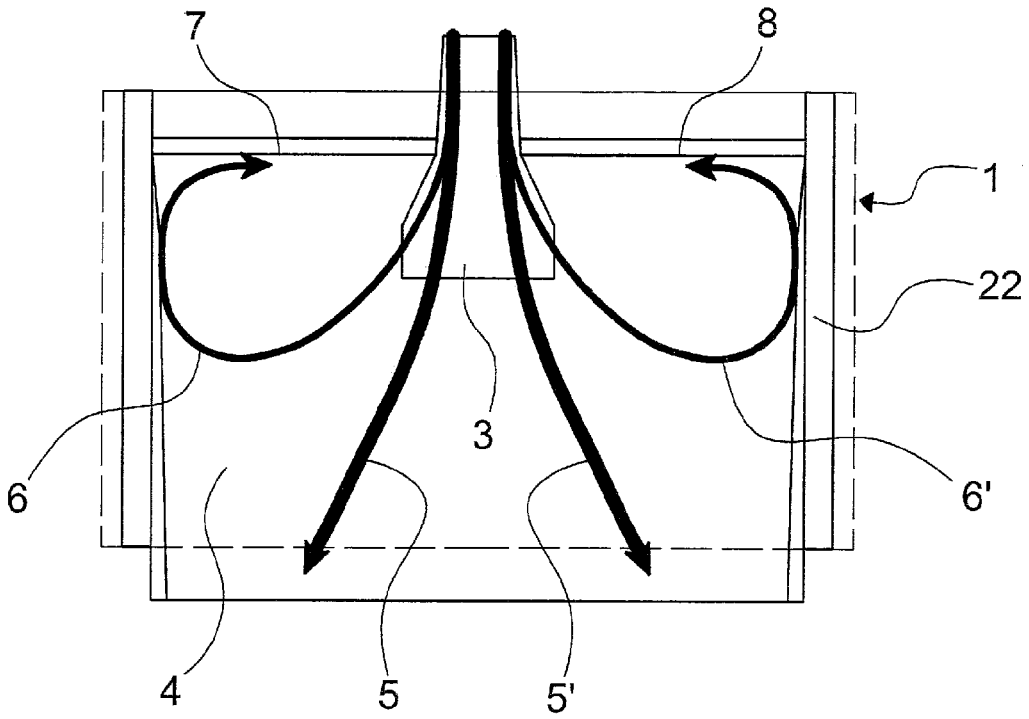
FIGS. 1 and 2 are views of a crystallizer of known type and show a liquid metal bath contained in the crystallizer and subjected to first and second possible fluid-dynamic conditions, respectively.
Figure 2:
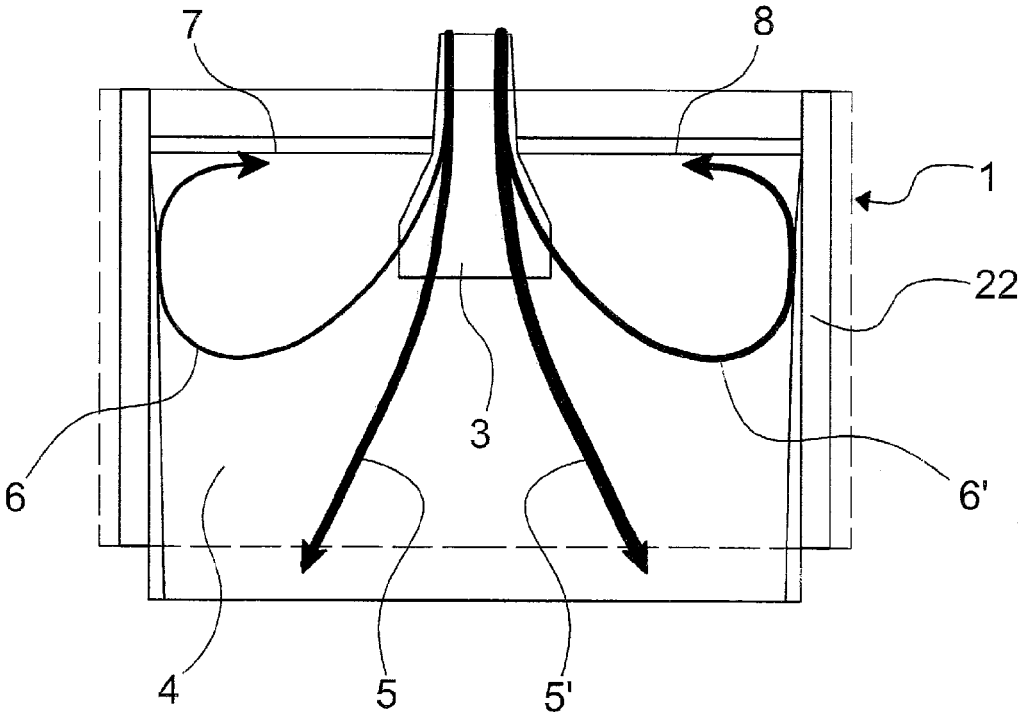
Figure 3:
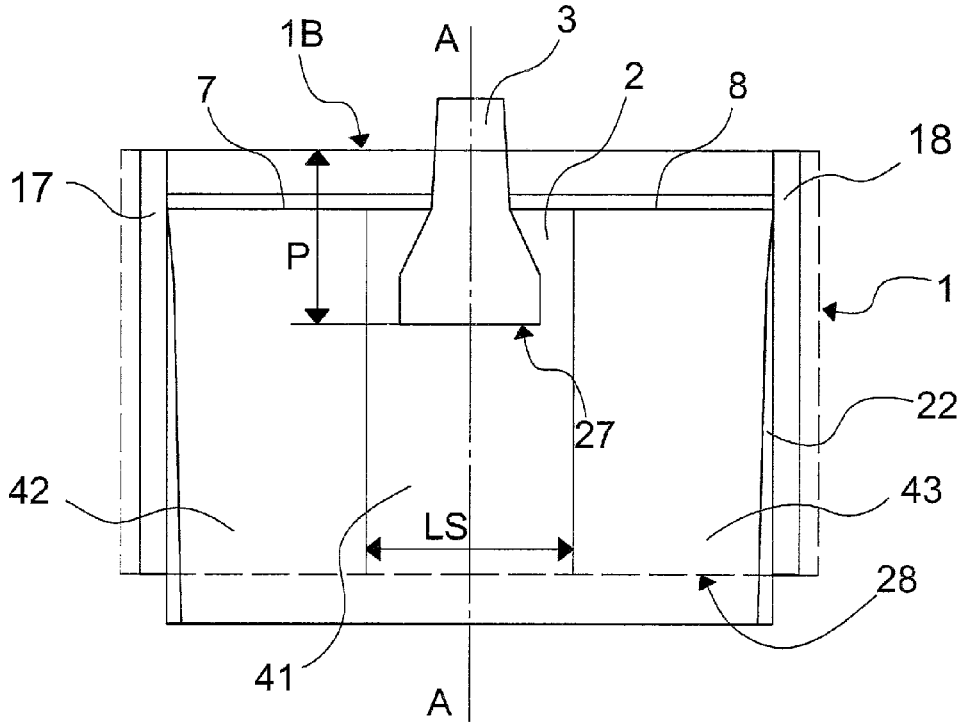
FIGS. 3 and 4 are front and plan views, respectively, of a crystallizer to which the process according to the present invention may be applied.
Figure 4:
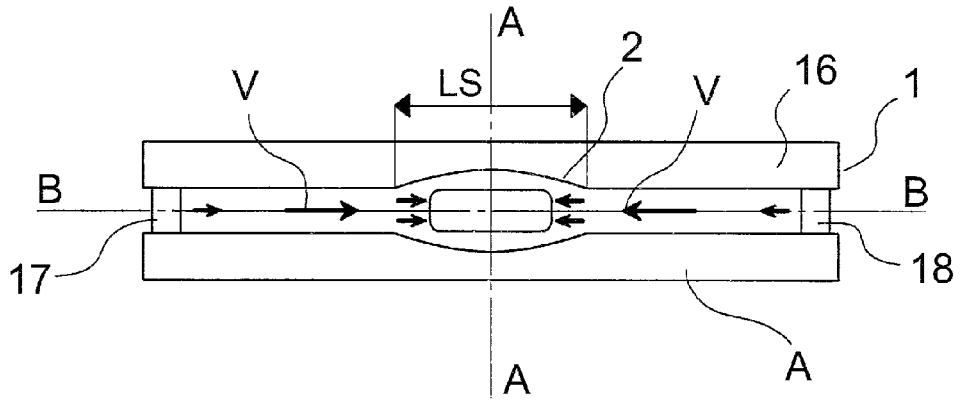

With reference to the mentioned figures, the process according to the invention allows to regularize and control the flows of liquid metal in a crystallizer for continuously casting thin slabs. Such a crystallizer 1 is defined by perimetral walls made of metal material, preferably copper, which define an inner volume adapted to contain a bath 4 of liquid metal, preferably steel. FIGS. 3 and 4 show a possible embodiment of such a crystallizer 1, delimited by a dashed line, which comprises two mutually opposite front walls 16, 16' and two reciprocally parallel sidewalls 17, 18 substantially orthogonal to the front walls 16, 16'.

The inner volume delimited by the perimetral walls 16, 16', 17, 18 has a first longitudinal symmetry plane B-B parallel to the front walls 16, 16' and a transversal symmetry plane A-A orthogonal to the longitudinal plane B-B. The inner volume defined by crystallizer 1 is open at the top to allow the insertion of liquid metal and is open at the bottom to allow the metal itself come out in the form of substantially rectangular, semi-finished product, upon solidification of an outer skin layer 22 at the inner surface of the perimetral walls 16, 16', 17, 18.

The front perimetral walls 16, 16' comprise a central enlarged portion 2 which defines a central basin, the size of which is suited to allow the introduction of a discharger 3 through which the liquid metal is continuously introduced into the bath 4. Such a discharger 3 is immersed in the inner volume of the crystallizer by a depth P (see FIG. 3) measured from an upper edge 1B of the walls 16, 16', 17, 18 of crystallizer 1. Discharger 3 comprises an outlet section 27, which symmetrically develops both with respect to the transversal symmetry plane A-A and with respect to the longitudinal symmetry plane B-B. The outlet section 27 defines one or more openings through which the bath 4 is fed with metal liquid from a ladle, for example.

Again with reference to the view in FIG. 3, the inner volume of crystallizer 1 i.e. the liquid metal bath 4 contained therein is divided into a central portion 41 and two side portions 42 and 43 symmetric with respect to the central portion 41. In particular, the term "central portion 41" means a portion which longitudinally extends (i.e. parallel to the direction of plane B-B) over a distance LS corresponding to the extension of the widened portions 2 of walls 16, 16' which define the central basin, as shown in FIG. 4, symmetrically with respect to the vertical axis A-A. Moreover, the central portion 41 vertically develops over the whole extension of crystallizer 1. The term "side portions 42, 43" means instead two portions of bath 4 which each develop from one of the sidewalls 17, 18 of crystallizer 1 and the central portion 41, as defined above. In particular, the portion between the central part 41 and a first sidewall 17 (on the left in FIG. 3) will be indicated as the first side portion 42, and the portion symmetrically opposite to the transversal plane A-A, between the central portion 41 and the second sidewall 18, will be indicated as the second side portion 43.

The process according to the present invention includes generating a plurality of braking zones 10, 11, 12, 13, 14, 15 within the liquid metal bath 4, each through an electromagnetic brake 10', 11', 12', 13', 14', 15'. The process further includes activating these braking zones 10, 11, 12, 13, 14, 15 according to characteristic parameters of the fluid-dynamic conditions of the liquid material within bath 4. In particular, the braking zones are activated either independently from one another and also in groups according to the parameters related to speed and waviness of the liquid metal in proximity of the surface 7 (or meniscus 7) of bath 4. Furthermore, the braking zones are also activated according to the liquid metal flow rates in the various portions 41, 42, 43 of the liquid bath 4, as explained in greater detail below.

Figure 13:
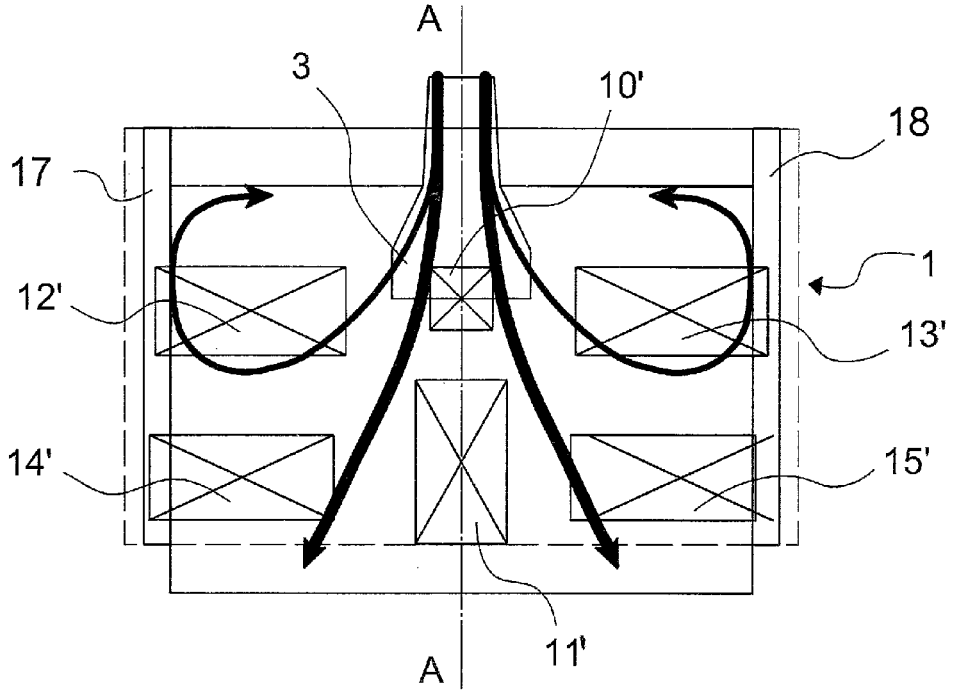
FIG. 13 is a front view of a first embodiment of an apparatus for implementing the process according to the present invention.
Figure 14:
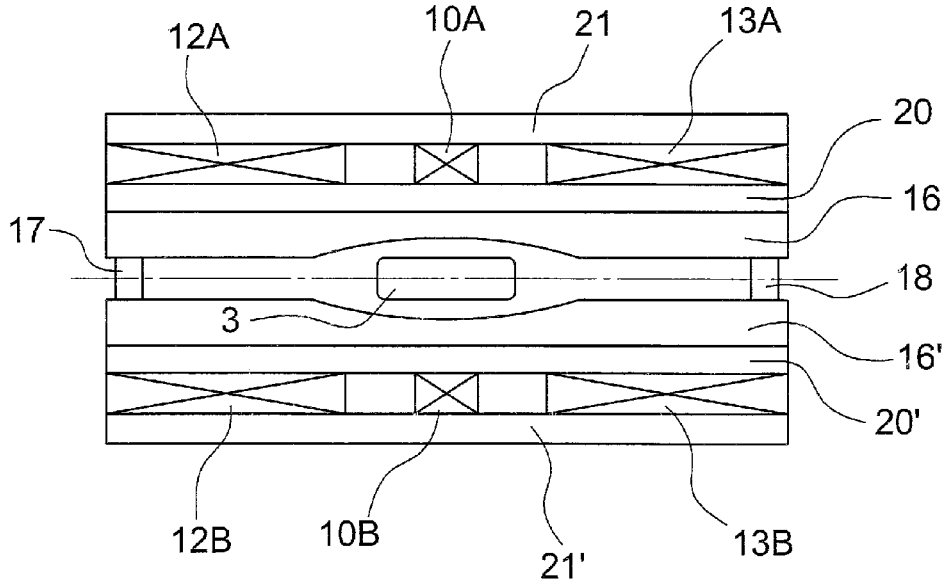
FIG. 14 is a plan view of the apparatus in FIG. 13.

Each braking zone 10, 11, 12, 13, 14, 15 is thus defined by a region of the liquid metal bath 4 which is crossed by a magnetic field generated by a corresponding electromagnetic brake 10', 11', 12', 13', 14', 15' placed outside crystallizer 1, as shown in FIGS. 13 and 14. More specifically, the electromagnetic brakes 10', 11', 12', 13', 14', 15' are arranged outside reinforcing sidewalls 20 and 20' adjacent to the front walls 16, 16'. The electromagnetic brakes 10', 11', 12', 13', 14', 15' are configured so that the magnetic field generated therefrom crosses bath 4 preferably according to directions substantially orthogonal to the longitudinal plane B-B. This solution allows a greater braking action in the liquid bath while advantageously allowing to contain the size of the brakes 10', 11', 12', 13', 14', 15' themselves. However, these electromagnetic brakes 10', 11', 12', 13', 14', 15' may be configured so as to generate magnetic fields with lines either substantially vertical, i.e. parallel to the transversal symmetry plane A-A, or alternatively with horizontal lines, i.e. perpendicular to the transversal plane A-A and parallel to the longitudinal plane B-B, within bath 4.

Hereinafter, for the purposes of the present invention, the term "activated braking zone" in the liquid bath 4 means a condition according to which an electromagnetic field is activated, generated by a corresponding electromagnetic brake, which determines a braking action of the liquid metal 4 which concerns the zone itself. The term "deactivated braking zone"

means instead a condition according to which such a field is "deactivated" to suspend such a braking action at least until a new reactivation of the corresponding electromagnetic brake. As indicated below, each of the braking zones 10, 11, 12, 13, 14, 15 may be activated either in combination with other braking zones 10, 11, 12, 13, 14, 15, or one at a time, i.e. including a simultaneous "deactivation" of the other braking zones 10, 11, 12, 13, 14, 15.

Figure 5:
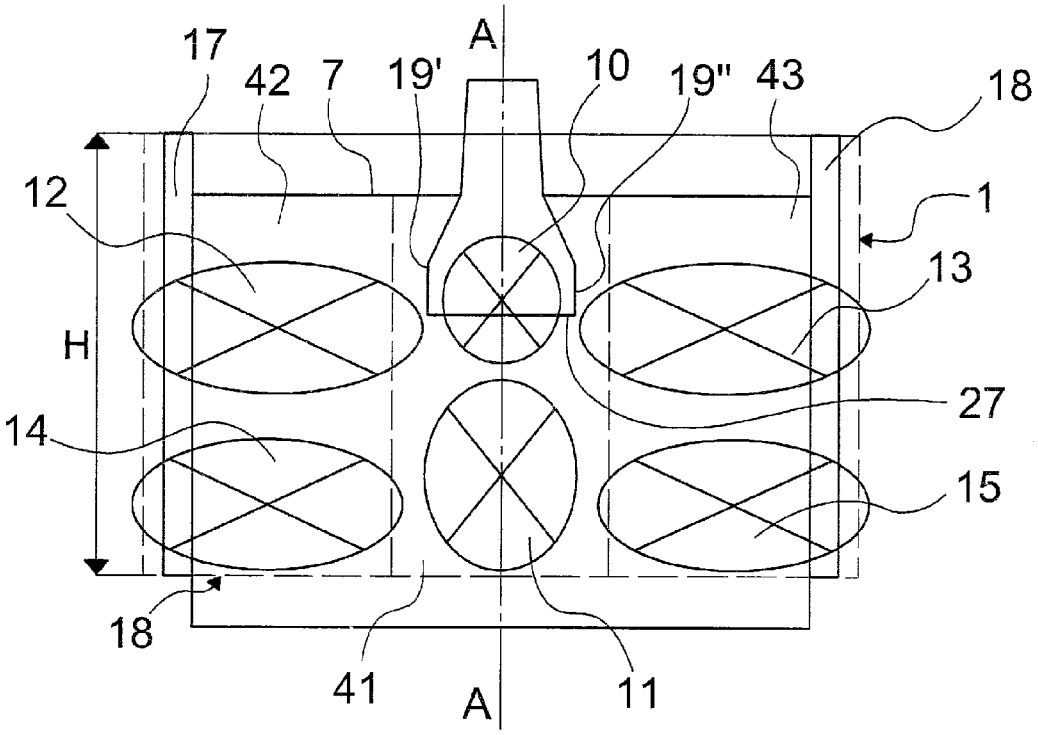
FIG. 5 is a front view of the crystallizer in FIG. 3 in which braking zones are indicated according to a possible embodiment of the process according to the present invention.

FIG. 5 frontally shows a crystallizer 1 to which the process according to the present invention is applied. In particular, such a figure shows braking zones 10, 11, 12, 13, 14, 15 which may be activated according to the fluid-dynamic conditions inside bath 4. According to the invention, a first electromagnetic brake 10' is arranged to generate a first braking zone 10 in the central portion 41 of bath 4 in proximity of the outlet section 27 of the discharger 3. More specifically, the first braking zone 10 develops symmetrically with respect to the transversal symmetry plan A-A and has a side extension (measured according to the direction parallel to the side plane B-B) which is smaller than the side extension of the same outlet section 27.

As shown again in FIG. 5, the position of the first braking zone 10 is such that when it is activated the main flows 5, 5' of liquid metal are slowed down precisely in proximity of the outlet section 27 of discharger 3 in favor of the secondary recirculations 6, 6', which thereby are reinforced and increase their speed. The expression "in proximity of the outlet section 27" indicates a portion of the liquid metal bath essentially next to said outlet section, as shown in FIG. 5, for example. As specified in greater detail below with reference to FIG. 6, the activation of the first braking zone 10 is thus particularly advantageous in the presence of relatively low flow rates which may determine slow liquid metal speed in proximity of the meniscus 7 of bath 4.

According to a preferred solution, the size of the first braking zone 10 (indicated in FIG. 6) is established so that the ratio of the side extension L10 of the first braking zone 10 to the side size L27 of the outlet section 27 of discharger 3 is between ⅓ and 1. Furthermore, the ratio of the vertical extension V10 of the first braking zone 10 (above the outlet section 27) to the distance V27 between the outlet section 27 and the surface 7 of bath 4 is preferably in a range between 0 and 1. Furthermore, the ratio of the vertical extension V9 of the first braking zone 10 (under said outlet section 27) to the side extension L27 of discharger 3 is between 0 and 1, being preferably equal to ⅔.

According to the invention, a second electromagnetic brake 11' is set up to generate a second braking zone 11 in a position mainly underneath the first braking zone 10. The second braking zone 11 is such to extend symmetrically with respect to the transversal symmetry plane A-A and is preferably comprised in the central portion 41 of bath 4. The ratio of the side extension L11 of the second braking zone 11 to the side size LS of the central part 41 is preferably between ⅛ and ⅔ (see FIG. 8). The second braking zone 11 may extend vertically from the bottom 28 of crystallizer 1 to the outlet section 27 of discharger 3, preferably from ⅙ of the height H of crystallizer 1 to a distance D11 from the outlet section 27 of discharger 3 corresponding to about ¼ of the width L27 of the same outlet section 27.

A third electromagnetic brake 12' is arranged to generate a third braking zone 12 in the first side portion 42 of bath 4 so as to be laterally comprised between the inner surface of the first perimetral wall 17 and the transversal symmetry plane A-A. Such a third braking zone 12 preferably extends laterally between the inner surface of the first sidewall 17 and a first side edge 19' of discharger 3 facing the same first sidewall 17. The third braking zone 12 may be vertically developed from ⅓ of the height H of crystallizer 1 to the meniscus 7 of bath 4, preferably from half the height H of crystallizer 1 to a distance D12 from the surface 7 of bath 4 equal to ⅙ of the side size L27 of discharger 3.

A fourth electromagnetic brake 13' is arranged to generate a fourth braking zone 13 substantially mirroring the third braking zone 12 with respect to the transversal symmetry axis A-A. More precisely, such a fourth braking zone 13 develops in the second portion 43 of bath 4 so as to be laterally comprised between the inner surface of the second sidewall 18 and the transversal symmetry plane A-A of crystallizer 1 and preferably between such an inner surface and a second side edge 19" of discharger 3 facing said second sidewall 18. As for the third braking zone 12, the fourth braking zone 13 may also be vertically developed from ⅓ of the height of crystallizer 1 to the meniscus 7 of bath 4, preferably from half the height of crystallizer 1 to a distance D12 from the surface 7 of bath 4 equal to ⅙ of the side size L27 of discharger 3.

A fifth electromagnetic brake 14' is arranged to generate a corresponding fifth braking zone 14 mainly in the first side portion 42 of bath 4 and mainly in a position underneath the third braking zone 12 defined above. The fifth braking zone 14 preferably extends so as to be completely comprised between the first sidewall 17 and the central portion 41. The fifth braking zone 14 may vertically extend between the lower edge 28 of crystallizer 1 and the outlet section 27 of discharger 3, preferably from a height d of about ⅐ of the height H of crystallizer 1 to a distance D14 (in FIG. 6) from the outlet section 27 of discharger 3 equal to about ⅓ of the width L27 of the discharger itself.

A sixth electromagnetic brake 15' is arranged to generate a sixth braking zone 15 substantially mirroring the fifth braking zone 14 with respect to the transversal symmetry axis A-A. The sixth braking zone 15 is therefore located in the second side portion 43 of the liquid bath 4 and mainly extends in a position underneath the fourth braking zone 13. The sixth braking zone 15 is preferably completely located within the second side portion 43 of bath 4, i.e. between the second sidewall 18 and the central portion 41. As for the fifth braking zone 14, the sixth braking zone 15 may also vertically extend between the lower edge 28 of crystallizer 1 and the lower section 27 of discharger 3, preferably from a height equal to about ⅐ of the height H of crystallizer 1 to a distance D14 from the outlet section 27 equal to about ⅓ of the width of the discharger itself.

As seen, the arrangement of six braking zones 10, 11, 12, 13, 14, 15 allows to advantageously correct multiple fluid-dynamic situations which, otherwise, would lead to faults in the semi-finished product, even to destructive break-out phenomenon. It is worth noting that the activation of the first braking zone 10 and of the second braking zone 11 allows to advantageously slow down the central flows 5, 5' of liquid metal in proximity of the outlet section 27 of discharger 3 and in a lower region close to the bottom 28 of crystallizer 1, respectively. The activation of the third braking zone 12 and of the fourth braking zone 13 (hereinafter also referred to as "upper side braking zones") allows instead to slow down the metal flows 6, 6' which are directed towards the meniscus 7, while the activation of the fifth braking zone 14 and of the sixth braking zone 15 (hereinafter also referred to as "lower side braking zones") allows to slow down the flows close to the bottom of bath 4. As specified more in detail below, the braking zones may explicate a different braking action according to the intensity of the magnetic field generated by the respective electromagnetic brakes. In particular, each braking zone 10, 11, 12, 13, 14, 15 may be advantageously isolated with respect to the braking zones 10, 11, 12, 13, 14, 15, i.e. be surrounded by a region of "non-braked" liquid metal. In all cases, the possibility of the magnetic fields overlapping within bath 4, thus determining an overlapping of the braking zones 10, 11, 12, 13, 14, 15 is considered within the scope of the present invention.

Figure 6:
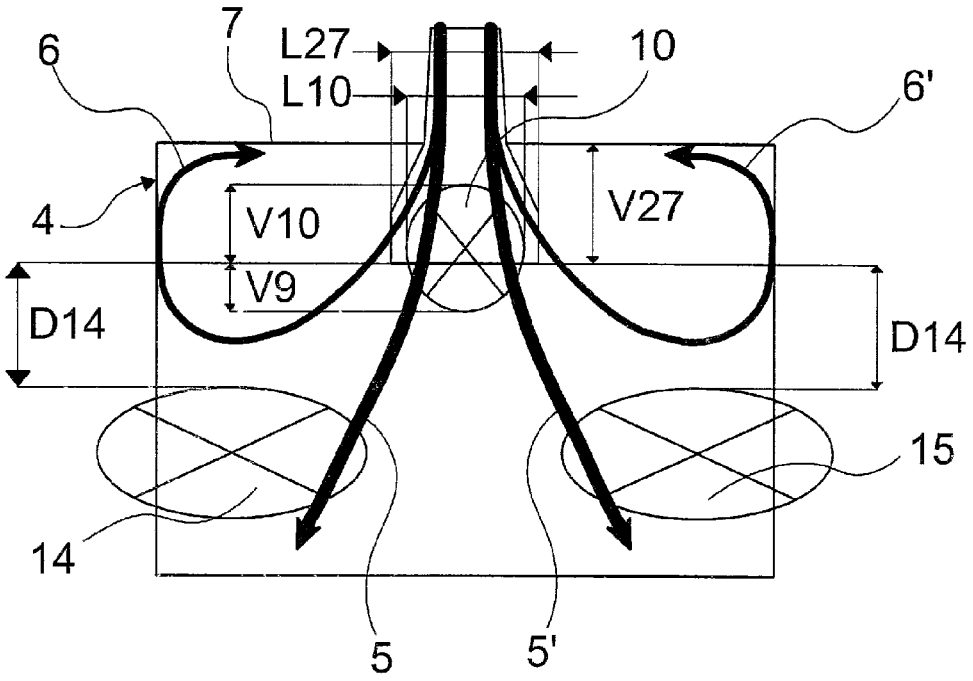
FIG. 6 is a view of a liquid metal bath in the crystallizer in FIG. 5 in which braking zones of the liquid metal activated in the presence of a first fluid-dynamic condition are indicated.

FIG. 6 relates to a first fluid-dynamic situation in which the flow rates inserted by discharger 3 are relatively low, thus determining excessively weak secondary recirculations 6 and 6' towards the meniscus 7, which do not ensure adequate speeds for the meniscus to work with a good casting speed and good final quality. In the presence of this situation, i.e. when the speed V of the liquid metal in proximity of the meniscus 7 is lower than a first reference value, the first braking zone 10 is then activated so as to explicate a braking action in bath 4 in a central zone in proximity of the outlet section 27 of discharger 3. The expression "in proximity of the meniscus 7" indicates a liquid metal bath which extends substantially between the meniscus 7 and a reference plane substantially parallel to the meniscus 7 and wherein the outlet section of the discharger is virtually arranged.

Increasing the fluid-dynamic resistance, a strengthening of the secondary recirculations 6 and 6' is determined in this zone, i.e. the speed V in proximity of surface 7 is increased. If the speed V in proximity of surface 7 is lower than a second reference value, however higher than the first value, the fifth braking zone 14 and the sixth braking zone 15 are then activated in order to further strengthen the secondary recirculations 6, 6', i.e. restore the speeds V at the meniscus 7.

Figure 7:
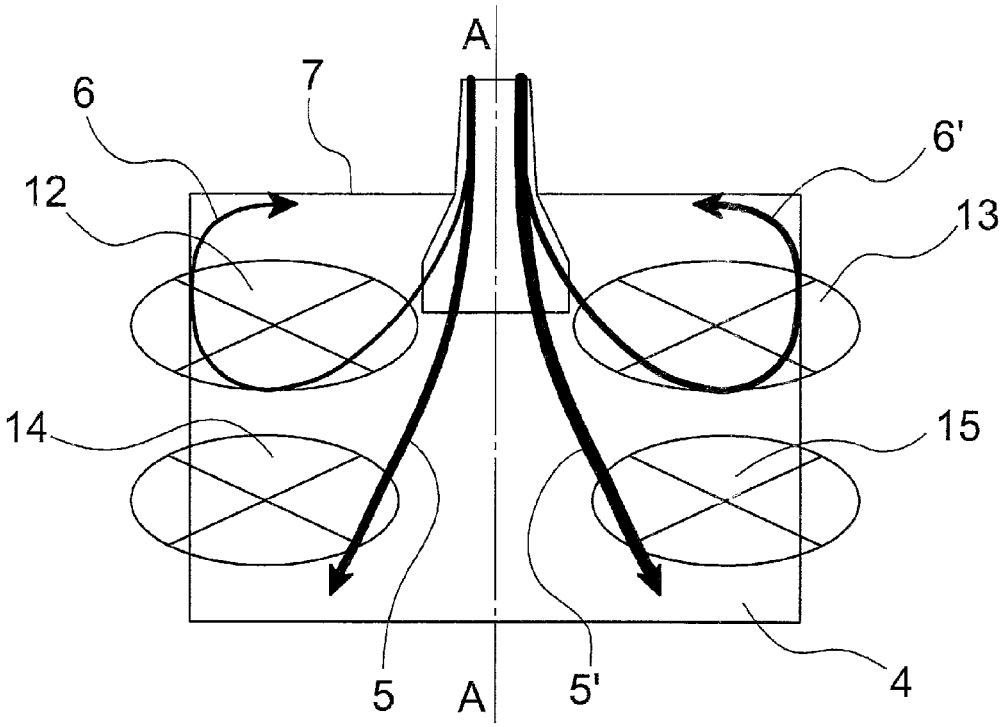
FIG. 7 is a view of a liquid metal bath in the crystallizer in FIG. 5 in which braking zones of the liquid metal activated in the presence of a second fluid-dynamic condition are indicated.

FIG. 7 relates to a second possible fluid-dynamic situation in which an asymmetry condition of the metal flow rates directed from discharger 3 to the side portions 42, 43 of bath 4 is apparent. Under this condition, the braking zones located in the side portion 42, 43 of bath 4 are advantageously activated, to which a higher flow rate is directed. In this case shown in FIG. 7, the metal flows 5', 6' directed to the second side portion 43 of the metal bath 4 are more intense (i.e. at higher speed) than those directed towards the other portion. Under this condition, the fourth braking zone 13 and the sixth braking zone 15 mainly located precisely in the second portion 43 are advantageously activated. This solution generates a fluid-dynamic resistance towards the most intensive flows 5', 6', thus favoring a more symmetric redistribution of the flow rates in the liquid metal bath 4.

Again with reference to FIG. 7, if the flow rates were in all cases excessive, the side braking zones located in the side portion, to which a lower flow rate is directed, could be advantageously activated to obtain optimal conditions. In this case, the intensity of the braking action in the latter zones is established so as to be lower than that in the other side zones. In this case shown in FIG. 7, for example, the braking intensity in the third braking zone 12 and in the fifth braking zone 14 is established to be lower than that in the fourth braking zone 13 and in the sixth braking zone 15 in which the most intense flows 5', 6' act.

Figure 8:
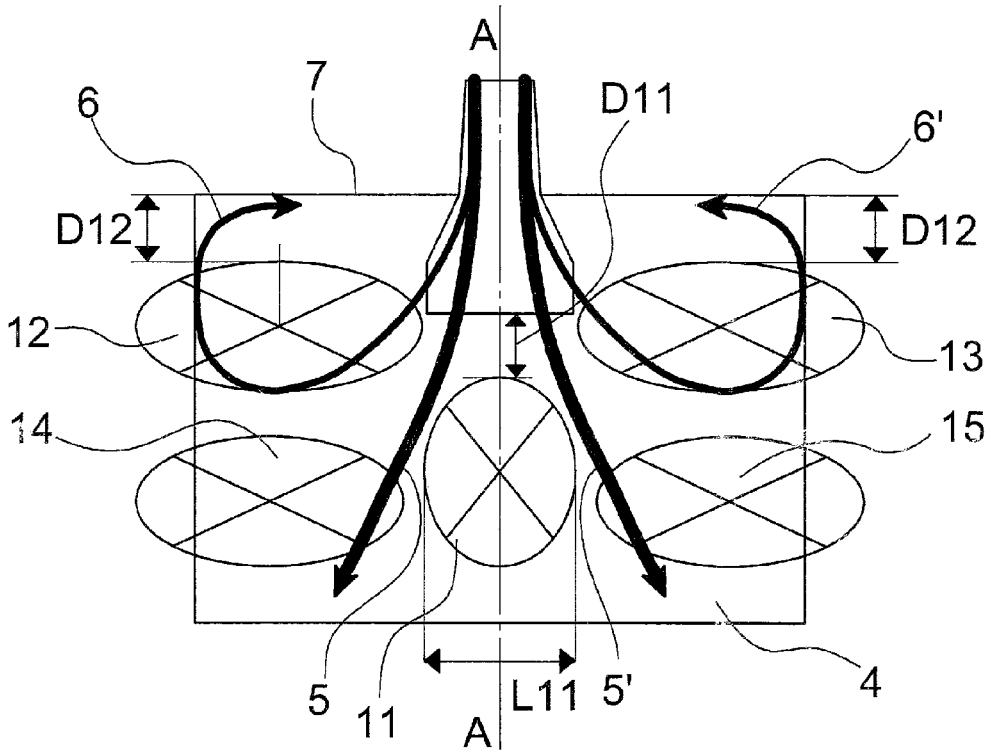
FIG. 8 is a view of a liquid metal bath in the crystallizer in FIG. 5 in which braking zones of the liquid metal activated in the presence of a third fluid-dynamic condition are indicated.

FIG. 8 refers to a third possible condition in which high, nearly symmetric flow rates are present, which result in excessive speed and waviness on the meniscus 7, and are such not to ensure optimal conditions for the casting process. Under this condition, when the speed V and the waviness of said liquid metal in proximity of the surface 7 exceed a predetermined reference value, all the concerned side zones are advantageously activated (third braking zone 12, fourth braking zone 13, fifth braking zone 14 and sixth braking zone 15). Furthermore, under this condition, the intensity of the braking action is differentiated so that the upper side braking zones (third braking zone 12 and fourth braking zone 13) develop a more intense braking action as compared to that developed by the lower side braking zones (fifth braking zone 14 and sixth braking zone 15). In order to improve casting process and conditions, the second lower central braking zone (i.e. the second braking zone 11) is preferably also activated in order to slow down the flows in the middle.

Under a further fluid-dynamic condition (FIGS. 9 and 10), in which only the secondary recirculations 6 and 6' are particularly intense (i.e. the speeds V at the meniscus 7 are higher than a predetermined value), in proximity of the surface 7 of the bath, only the upper side braking zone could be advantageously activated (third braking zone 12 and fourth braking zone 13). A possible activation of the second braking zone 11 advantageously allows to also brake the liquid metal flows 5, 5' in the middle of bath 4, thus re-establishing optimal fluid-dynamic conditions. Indeed, in proximity of the second braking zone 11, the metal flows could be affected by the previous activation of the third braking zone 12 and of the fourth braking zone 13.

Figure 11:
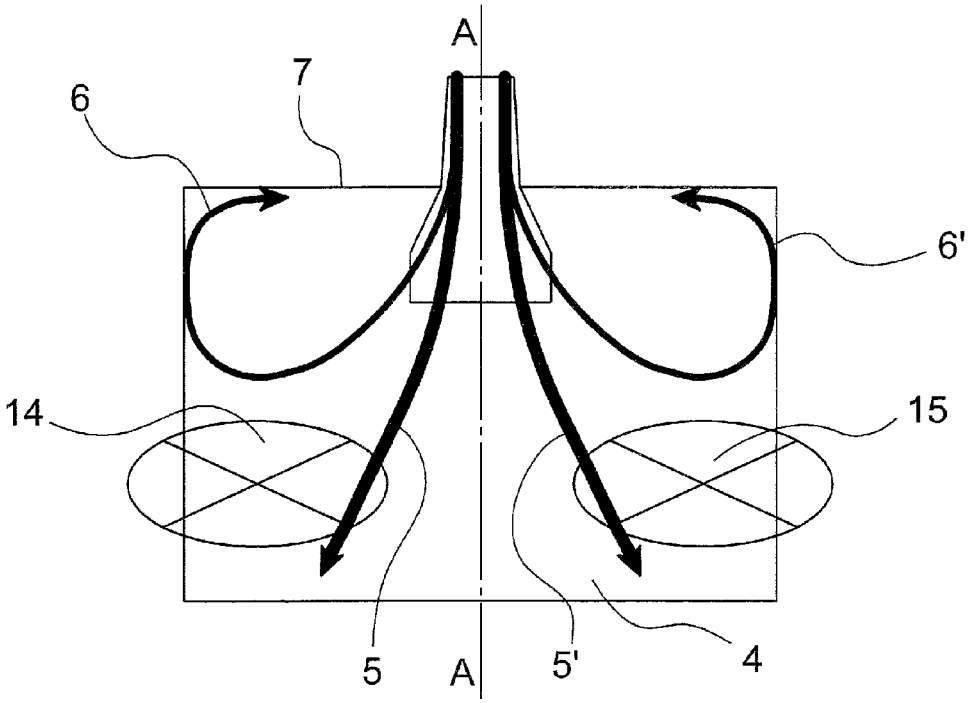
FIGS. 11 and 12 are views of a liquid metal bath in the crystallizer in FIG. 5 in which braking zones of the liquid metal activated in the presence of further fluid-dynamic condition are indicated.
Figure 12:
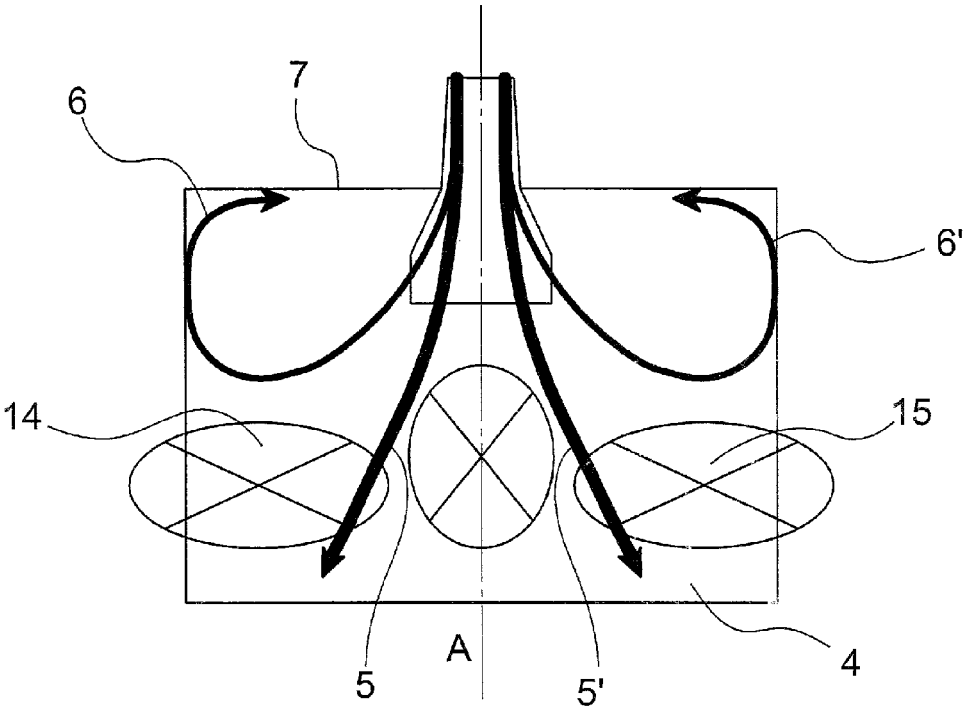

FIG. 11 relates to a further possible fluid-dynamic condition in which the main jets 5, 5' especially need to be braked, i.e. a condition in which the flow rate in the central portion 41 of bath 4 exceeds a predetermined value. In order to re-establish the correct redistribution of internal motions, the lower side braking zones (fifth braking zone 14 and sixth braking zone 15) may be advantageously activated. In order to optimize the distribution, the second side braking zone 11 within the same central portion 41 of bath 4, as shown in FIG. 12, may possibly be activated.

Figure 8A:
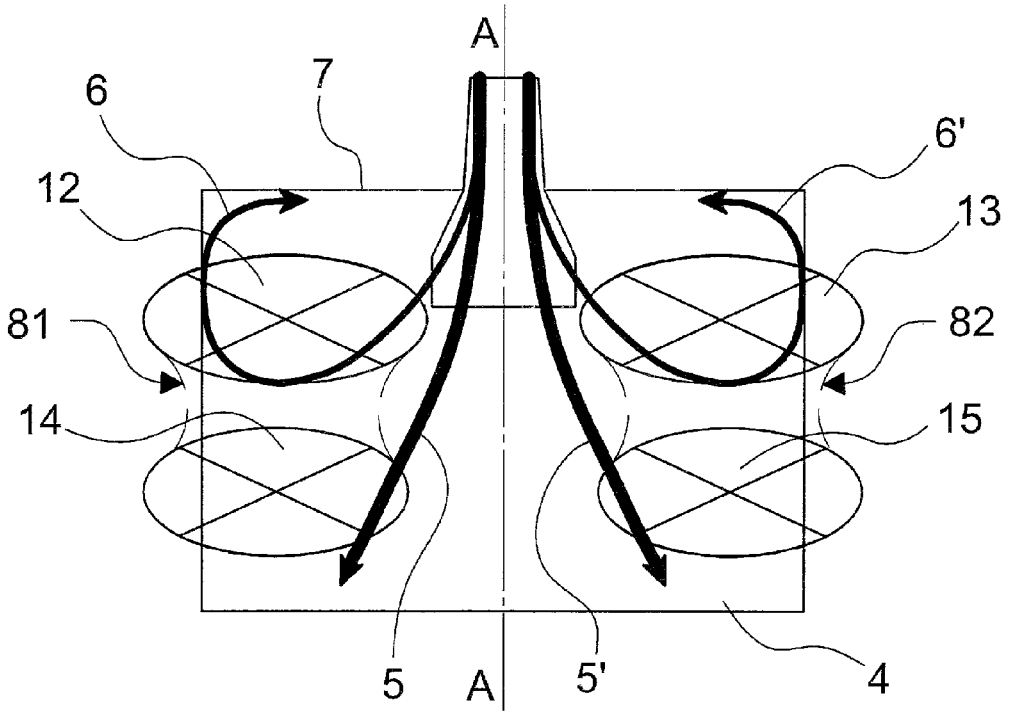
FIG. 8A is a view of a liquid metal bath in the crystallizer in FIG. 5 in which braking zone groups are shown.

As previously indicated, the braking zones 10, 11, 12, 13, 14, 15 may be each activated independently from one another, but alternatively may be activated in groups, thus meaning to indicate the possibility of activating several braking zones together so that some zones are at least partially joined in a single zone of action. With reference to FIG. 8A, for example, the side braking zones (indicated by reference numerals 12, 14, 13, 15) mainly located in a same side portion 42, 43 of the liquid bath 4 may be activated together so at so generate a single side braking zone (delimitated by a dashed line in FIG. 8A). In this case shown in FIG. 8A, the third braking zone 12 and the fifth braking zone 14 are activated together so as to generate a first side braking zone 81, while the fourth braking zone 13 and the sixth braking zone 15 are activated together so as to generate a second side braking zone 82 mirroring the first side braking zone 82 with respect to the transversal symmetry plane A-A.

Figure 8B:
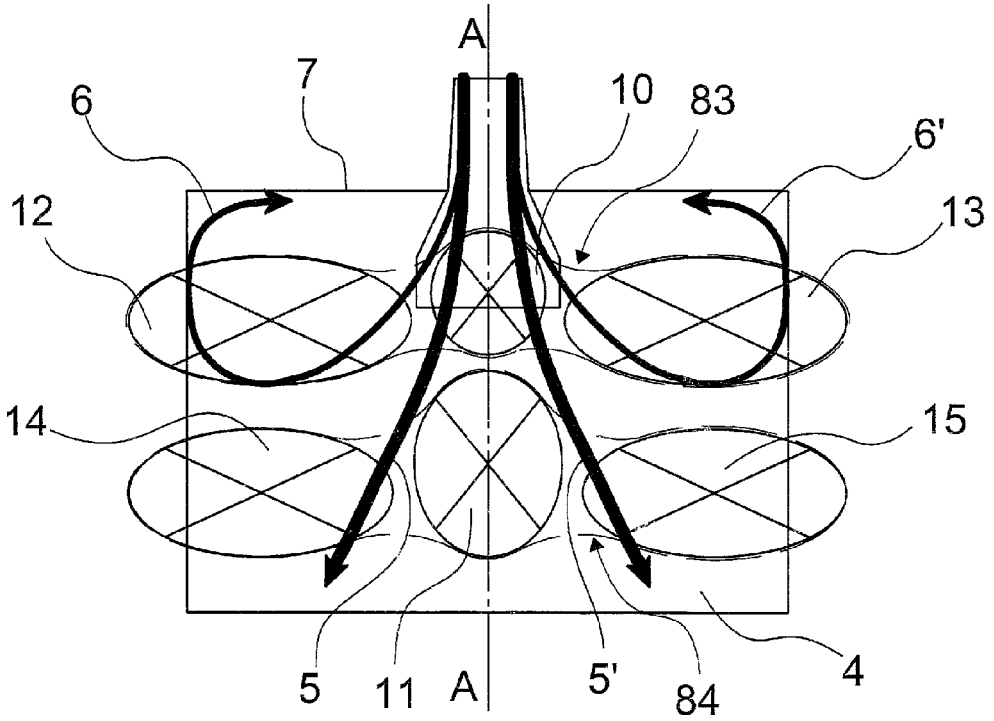
FIG. 8B is a view of a liquid metal bath in the crystallizer in FIG. 5 in which further braking zone groups are shown.

With reference to FIG. 8B, the braking zones (indicated by reference numerals 10, 12 and 13) in a position closest to the surface 7 of the bath (indicated by reference numerals 10, 12 and 13) may be operatively connected so as to generate a single upper braking zone 83, while the braking zones (indicated by reference numerals 11, 14, 15) in a position closest to the bottom of bath 4 may be in turn connected so as to generate a single lower braking zone 84. The activation of the lower braking zone 84 is advantageously provided, for example, in the case of particularly intense jets 5 as described above with reference to FIGS. 11 and 12, while the activation of the upper braking zone 83 is particularly advantageous in the case of particularly intense secondary recirculations 6, 6'.

The present invention further relates to a continuous casting apparatus for thin slabs which comprises a crystallizer 1, a discharger 3 and a device for controlling the flows of liquid metal in crystallizer 1. In particular, such a device comprises a plurality of electromagnetic brakes 10', 11', 12', 13', 14', 15', each of which generates, upon its activation, a braking zone 10, 11, 12, 13, 14, 15 within the liquid metal bath 4 defined by perimetral walls 16, 16', 17, 18 of crystallizer 1. Said electromagnetic brakes 10', 11', 12', 13', 14', 15' may be activated and deactivated independently from one another, or alternatively in groups. According to the present invention, there are six electromagnetic brakes each for generating, if activated, a braking zone as described above.

Preferably, the electromagnetic brakes 10', 11', 12', 13', 14', 15' each comprise at least one pair of magnetic poles arranged symmetrically outside the crystallizer 1 and each in a close and external position with respect to a thermal-mechanical reinforcing wall 20 or 20' adjacent to a corresponding front wall 16,16'. In a preferred embodiment, each pair of poles (one acting as a positive pole, the other as a negative pole) generates, upon its activation, a magnetic field which crosses the liquid metal bath 4 according to directions substantially orthogonal to the front walls 16, 16' of crystallizer 1. In this configuration, each magnetic pole (positive and negative) comprises a core and a supply coil wound about said core. The supply coils related to the magnetic poles of the same brake are simultaneously supplied to generate the corresponding magnetic field (i.e. to activate a corresponding braking zone), the intensity of which will be proportional to the supply current of the coils.

For each electromagnetic brake, the magnetic poles may be configured so as to generate an electromagnetic field, in which the lines cross bath 4, preferably according to directions orthogonal to the front walls 16, 16'. Alternatively, the magnetic poles could generate magnetic fields the lines of which cross either vertical or horizontal magnetic fluxes.

In a possible embodiment, for example, the magnetic poles of the same electromagnetic brake (e.g. the magnetic pole 10A and the magnetic pole 10B of the first brake 10' reciprocally symmetric to the plane B-B) could each comprise two supply coils arranged so as to generate a magnetic field, the lines of which cross the bath 4 either vertically or horizontally.

In a further embodiment, the magnetic field which crosses bath 4 could also be generated by the cooperation of magnetic poles belonging to various electromagnetic brakes, but arranged on the same side with respect to bath 4. For example, a magnetic pole of the third electromagnetic brake 12' and the magnetic pole of the fourth brake 13' placed on the same side with respect to bath 4 may be configured so as to act one as a positive pole and the other as a negative pole, so as to generate a magnetic field the lines of which cross bath 4.

In all cases, the use of electromagnetic brakes 10', 11', 12', 13', 14', 15' defined by two magnetic poles having a core and a supply coil wound about said core, allows to obtain corresponding braking zones 10, 11, 12, 13, 14, 15, each of which may be well defined and isolated with respect to the other zones. Furthermore, according to intensity, each braking zone 10, 11, 12, 13, 14, 15 may advantageously display a geometric conformation different from others. In essence, contrary to the solution described in FR 2772294, the electromagnetic brakes 10', 11', 12', 13', 14', 15' employed in the apparatus according to the invention allow to obtain braking zones possibly isolated from one another each with a specific geometric conformation.

Figure 15:
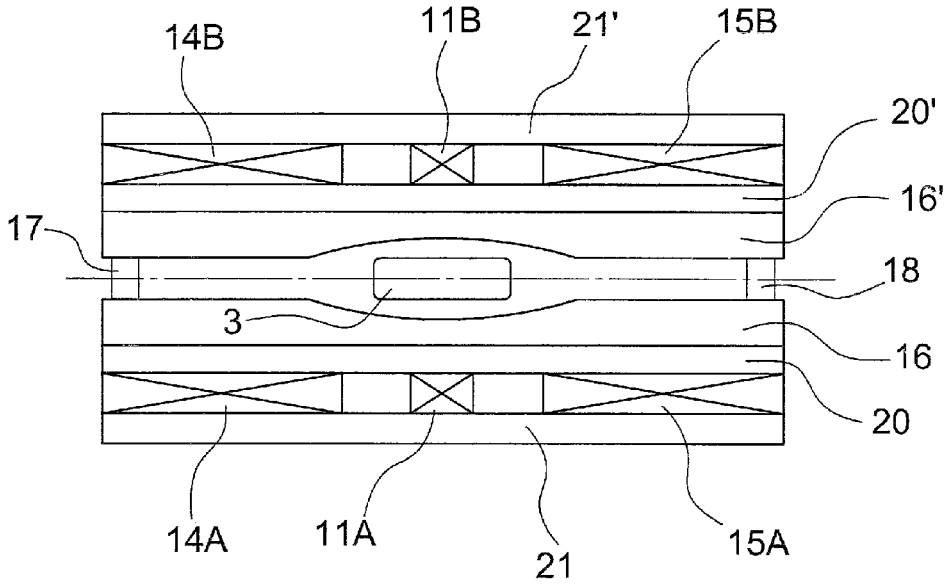
FIG. 15 is a view of the apparatus in FIG. 13, from a point of view opposite to that in FIG. 14.

FIGS. 13 and 14 are front and plan views, respectively, of a first possible embodiment of an apparatus according to the present invention. FIG. 15 is a further view of such an apparatus from a observation point opposite to that in FIG. 14. In particular, FIG. 13 allows to see the vertical position assigned to the magnetic poles of brakes 10', 11', 12', 13', 14', 15' for generating the various braking zones 10, 11, 12, 13, 14, 15. On the other hand, FIGS. 14 and 15 allow to see the symmetric position outside crystallizer 1, taken by the magnetic poles of each brake with respect to the longitudinal plane B-B. FIG. 14 shows only poles 10A, 10B, 12A, 12B, 13A, 13B of the first 10', third 12' and fourth 13' electromagnetic brake, for simplicity. Similarly, in FIG. 15 only the magnetic poles 11A, 11B, 14A, 14B, 15A, 15B related to the second electromagnetic brake 11', the third electromagnetic brake 14' and the sixth electromagnetic brake 15' are shown, for simplicity.

Considering, for example, the first electromagnetic brake 10, it is worth noting that a first magnetic pole 10A and a second magnetic pole 10B are symmetrically arranged with respect to the symmetry plane B-B and in a centered position on the transversal symmetry plane A-A. Similarly, the pairs of magnetic poles 12A, 12B and 13A, 13B, related to the third 13' and fourth 14' brakes, respectively, are symmetrically arranged with respect to the plane B-B, but at different heights and in other longitudinal positions from those provided for 10A, 10B of the first electromagnetic brake 10'.

According to a preferred embodiment, the apparatus comprises a pair of reinforcing walls 20, 20', each arranged in contact with a front wall 16, 16' of crystallizer 1 to increase the thermal-mechanical resistance thereof. The magnetic poles 12A, 12B, 13A, 13B, 10A, 10B of the various electromagnetic brakes are arranged in a position adjacent to these reinforcing walls 20, 20', which are made of austenitic steel to allow the magnetic field generated by the poles within bath 4 to pass.

The apparatus according to the invention preferably also comprises a pair of ferromagnetic plates 21, 21', each arranged parallel to the reinforcing walls 20, 20' so that, for each electromagnetic brake 10', 11', 12', 13', 14', 15', each magnetic pole is between a ferromagnetic plate 21, 21' and a reinforcing wall 20, 20'. With reference to FIG. 14, for example, it is worth noting that the magnetic poles 10A, 12A, 13A are between the ferromagnetic plate 21 and the reinforcing wall 20 adjacent to the first front wall 16, while the poles 10B, 12B, 13B are between the ferromagnetic plate 21' and the other reinforcing plate 20' adjacent to the second front wall 16' of crystallizer 1. Using the ferromagnetic plates 21, 21' allows to advantageously close the magnetic flux generated by the magnetic cores from the side opposite to the liquid metal bath 4. Thereby, the magnetic reluctance of the circuit is decreased to the advantage of a decrease of electricity consumed for activating the poles, considering the magnetic flux intensity as a constant.

If the apparatus is activated to correct the fluid-dynamic condition in FIG. 6, then through the first ferromagnetic plate 21, the magnetic flux may mainly be closed between the pole 10A and the poles 14A and 15A together. Similarly, on the side opposite to the longitudinal symmetry plan B-B, the magnetic flux may mainly be closed between the pole 10B and the poles 14B, 15B together.

Figure 9:
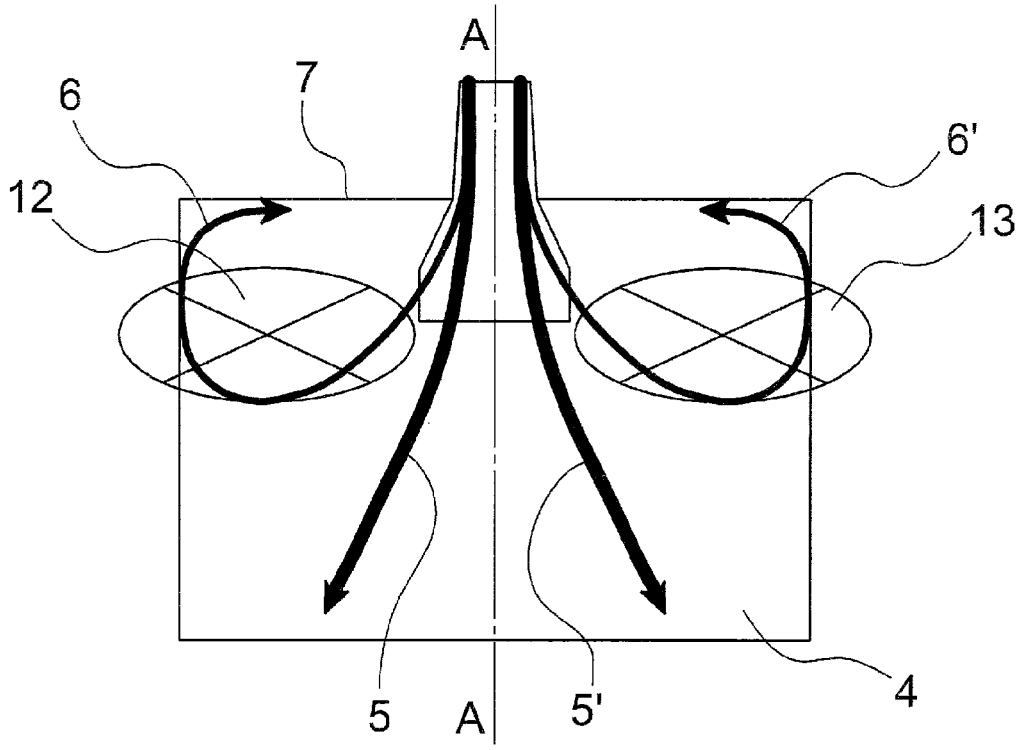
FIGS. 9 and 10 are views of a liquid metal bath in the crystallizer in FIG. 5 in which braking zones of the liquid metal activated in the presence of a fourth fluid-dynamic condition are indicated.
Figure 10:
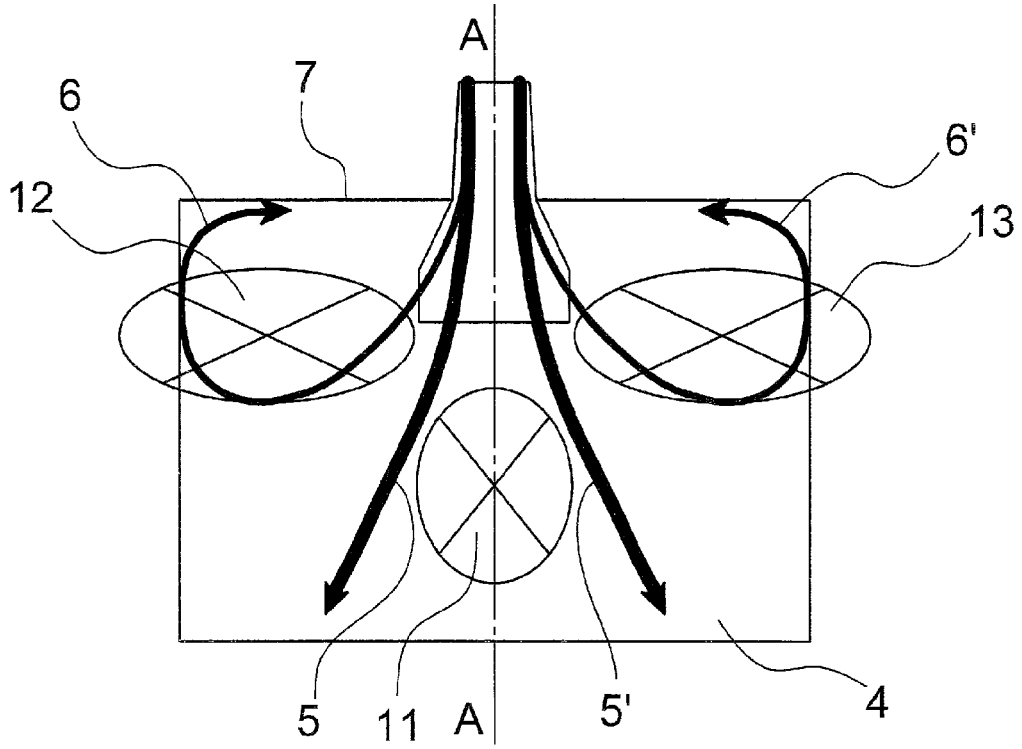

In this case shown in FIG. 9, in which the activation of the upper side zones 12, 13 is provided, the ferromagnetic plates 21, 21' allow the magnetic flux generated between the poles of the electromagnetic brakes 12' and 13' to be closed, while for the condition shown in FIG. 10, the ferromagnetic plates 21, 21' allow to close the magnetic flux generated between the poles by the electromagnetic brakes 12', 13' and 11'. In the cases shown in FIGS. 8, 8A and 8B, the magnetic flux between the poles of the electromagnetic brakes may advantageously be closed in various ways. For example, in the case in FIG. 8A, the magnetic flux may partially be closed between the poles 13A, 13B of brake 13' and the magnetic poles 15A, 15B of brake 15' activated together and partially between the magnetic poles 12A, 12B of brake 12' and the poles 14A, 14B of brake 14' activated together. Similarly, in the case in FIG. 8B, the magnetic flux is advantageously closed between the poles 10A, 10B, 12A, 12B, 13A, 13B of the electromagnetic brakes 10', 12', 13' activated in group, and the poles 11A, 11B, 14A, 14B, 15A, 15B of the electromagnetic brakes 11', 14', 15' also activated in group.

If weights and dimensions need to be reduced and/or the casting process does not require all the flexibility and configurations ensured by the plates 21, 21' made of ferromagnetic material, then the magnetic flux generated by the poles may be closed by means of direct ferromagnetic connections between the various poles. For the activation mode shown in FIG. 6, for example, and in the case of casting exclusively at low flow rates, a pair of upside-down, T-shaped plates may be arranged parallel to the reinforcing walls 20, 20' to allow the closing between the magnetic poles of the brakes 10', 14' and 15' which are activated. Similarly, in the activation mode shown in FIG. 10 dictated by casting conditions which require the secondary recirculations 6, 6' to be slowed down, two upside-down, T-shaped plates may be advantageously used instead of the larger ferromagnetic plates 21, 21'. In this case, each T-shaped plate will allow the magnetic flux to be closed, which is generated by the magnetic poles arranged on the same side with respect to the longitudinal symmetry plane B-B and belonging to the activated electromagnetic brakes 11', 12' and 13'.

Figure 16:
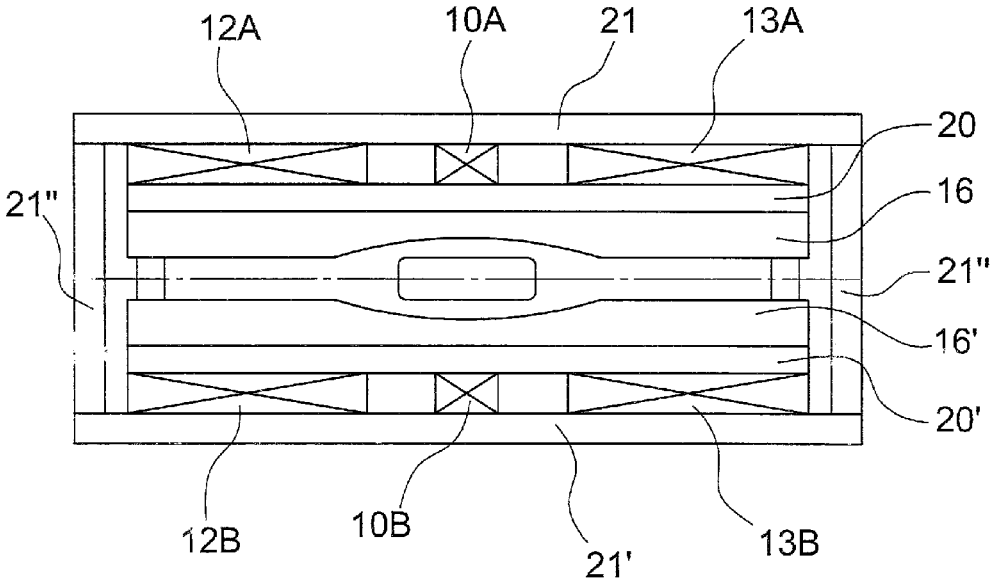
FIG. 16 is a plan view of a second embodiment of an apparatus according to the present invention.

FIG. 16 relates to a second embodiment of the apparatus according to the invention through which the magnetic flux is independently closed between two symmetric poles of the same electromagnetic brake (e.g. the symmetric poles 10A, 10B of the first brake 10' or the poles 12A, 12B of the third brake 12' or the poles 13A, 13B of the fourth electromagnetic brake 13') arranged adjacent to the two reinforcing walls 20, 20' made of austenitic steel. This configuration may be obtained by using a further pair of ferromagnetic plates 21", which transversally connect the two plates 21, 21' in proximity of the side edges of the latter. This solution allows to further reduce the reluctance of the magnetic circuit. In some particular cases, these two plates 21" may be replaced by the mechanical supporting structure of crystallizer 1 and by the thermal-mechanical reinforcing walls 20 and 20' (not shown).

Figure 17:
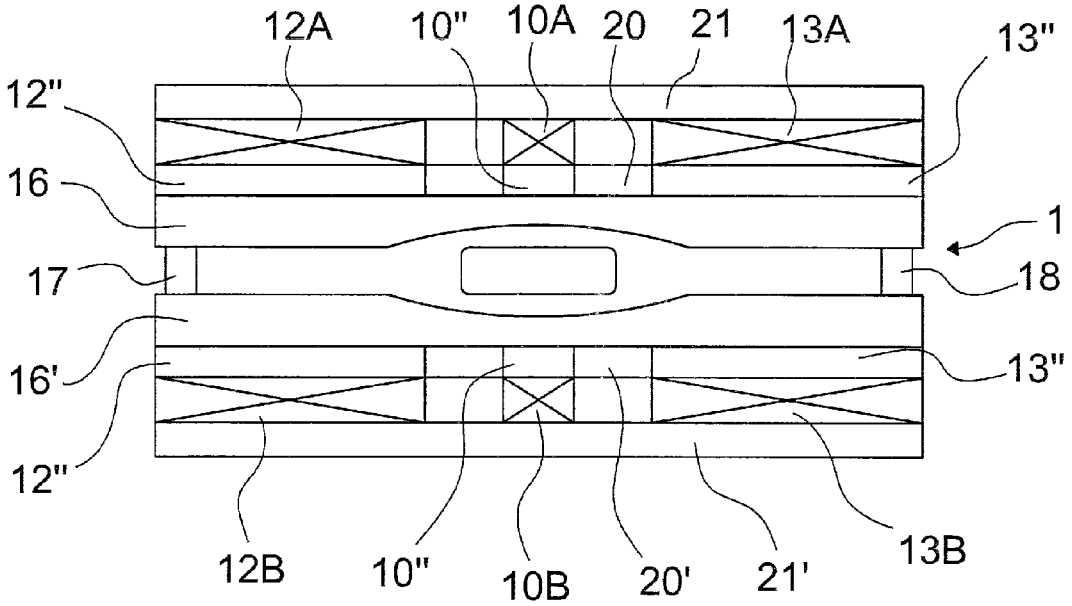
FIG. 17 is a plan view of a third embodiment of an apparatus according to the present invention.

FIG. 17 relates to a further embodiment of an apparatus according to the present invention, in which ferromagnetic inserts 10", 12", 13" are included in each of the walls 20, 20', of vertical and side dimensions either larger than or equal to that of the magnetic poles of the magnetic brakes 10', 12', 13', and either as thick as or thinner than the walls 20, 20' made of austenitic steel, respectively.

This solution allows to advantageously contain the electricity consumption intended to the coils which supply the magnetic poles of the various brakes 10', 11', 12', 13', 14', 15' to obtain the force intensities needed in the various braking zones 10, 11, 12, 13, 14, 15 which may be activated in bath 4.

Figure 18:
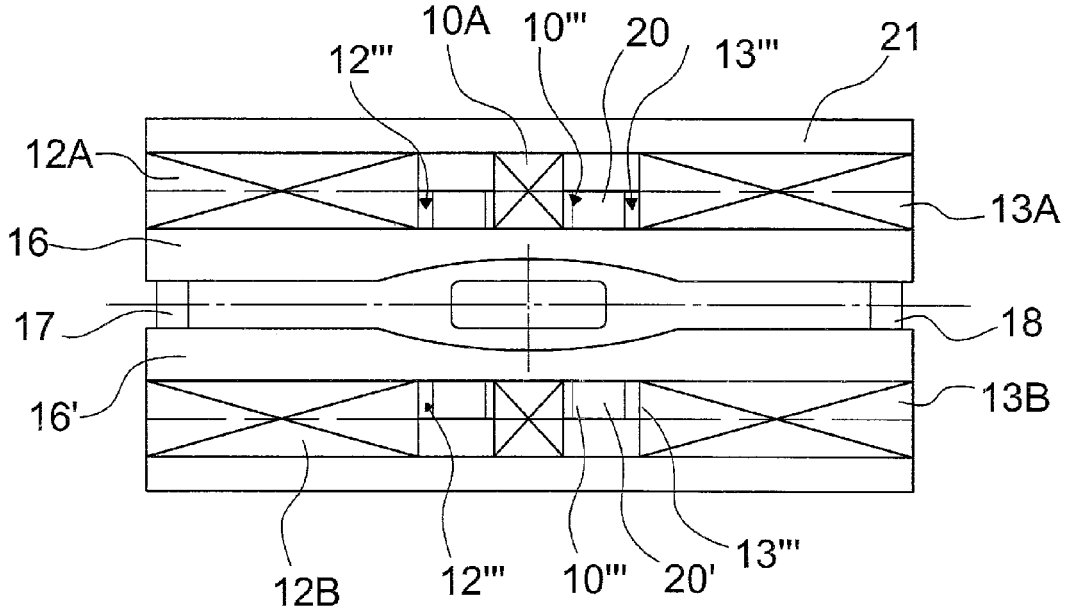
FIG. 18 is a plan view of a fourth embodiment of an apparatus according to the present invention.

FIG. 18 related to a further embodiment of the apparatus according to the invention which, similarly to the solution in FIG. 16, allows to contain the electricity used. In this case, each of the reinforcing walls 20, 20' made of austenitic steel comprises openings 10''', 12''', 13''', through which the corresponding magnetic poles of corresponding brakes 10', 12', 13', respectively, are arranged in order to place the same in a position close to the perimetral walls 16, 16' made of copper of crystallizer 1. In particular, these openings 10''', 12''', 13''' are larger than the corresponding magnetic poles and preferably of an oversized vertical measure to allow vertical oscillations to which crystallizer 1 is subjected during the casting process.

It is worth noting that in FIGS. 17 and 18 only the ferromagnetic inserts 10", 12", 13" and the openings 10''', 12''', 13''' related to the first brake 10', to the third brake 12 and to the fourth brake 13' are shown, respectively, but corresponding inserts and corresponding openings (not seen in these figures) are also provided for the second brake 11', for the fifth brake 14' and for the sixth electromagnetic brake 15. For all the embodiments disclosed above, the device for controlling the flows may be connected to crystallizer 1 and thus vertically oscillate therewith. However, in order to limit the moving masses, the apparatus remains preferably independent from crystallizer 1 and maintains a fixed position with respect to the latter. Furthermore, in all the considered cases, the intensity of the magnetic field may be independently established for each braking zone 10, 11, 12, 13, 14, 15 or several braking zones may have the same intensity. Such an intensity may reach 0.5 T. Excellent results in terms of performance and energy saving are thus reached when the intensity of the magnetic field is between 0.01 T and 0.3 T.

Figure 19:
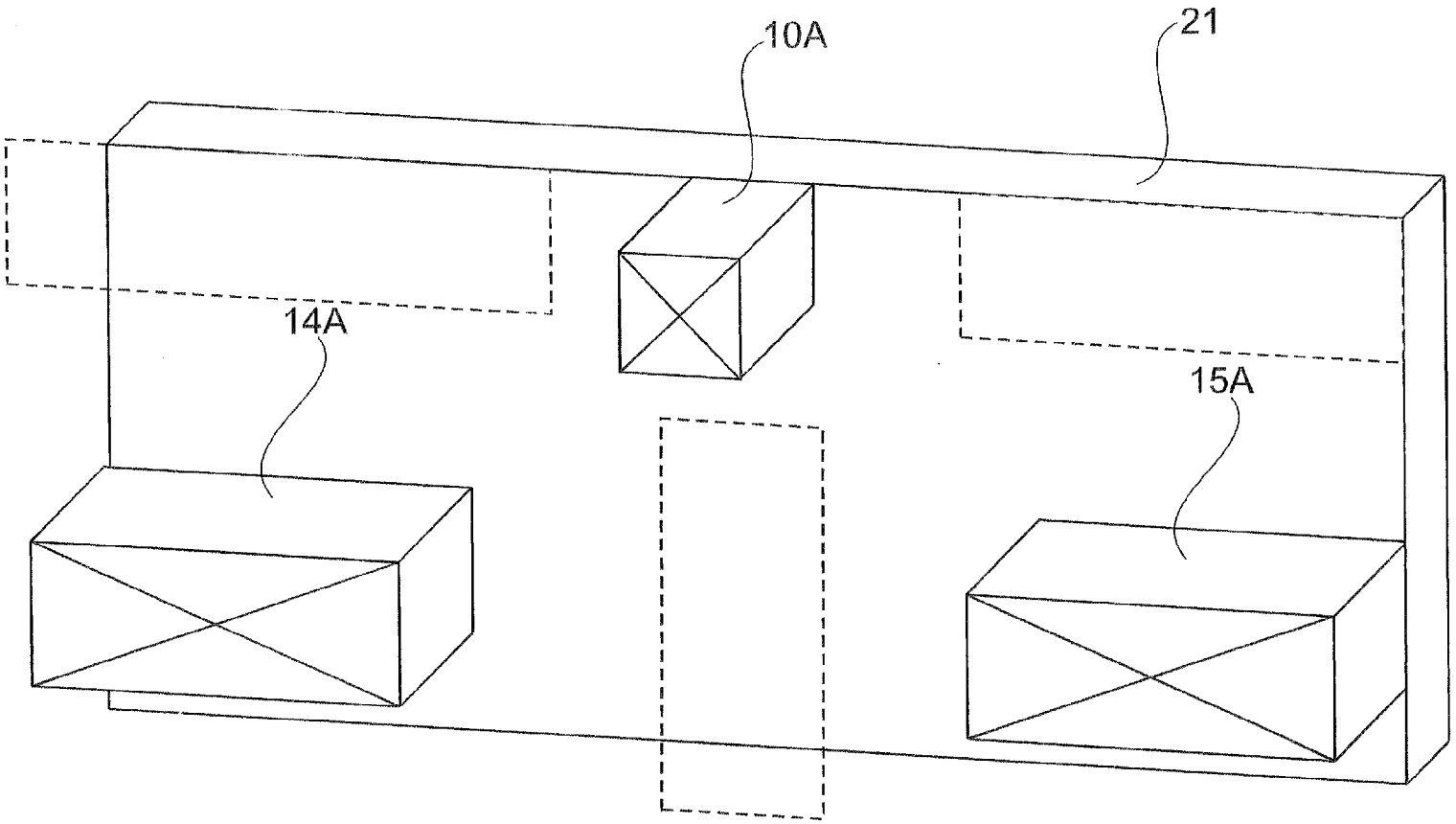
FIGS. 19, 20 and 21 respectively show three possible installation modes of a device for controlling liquid metal flows in a crystallizer of an apparatus according to the present invention.
Figure 20:
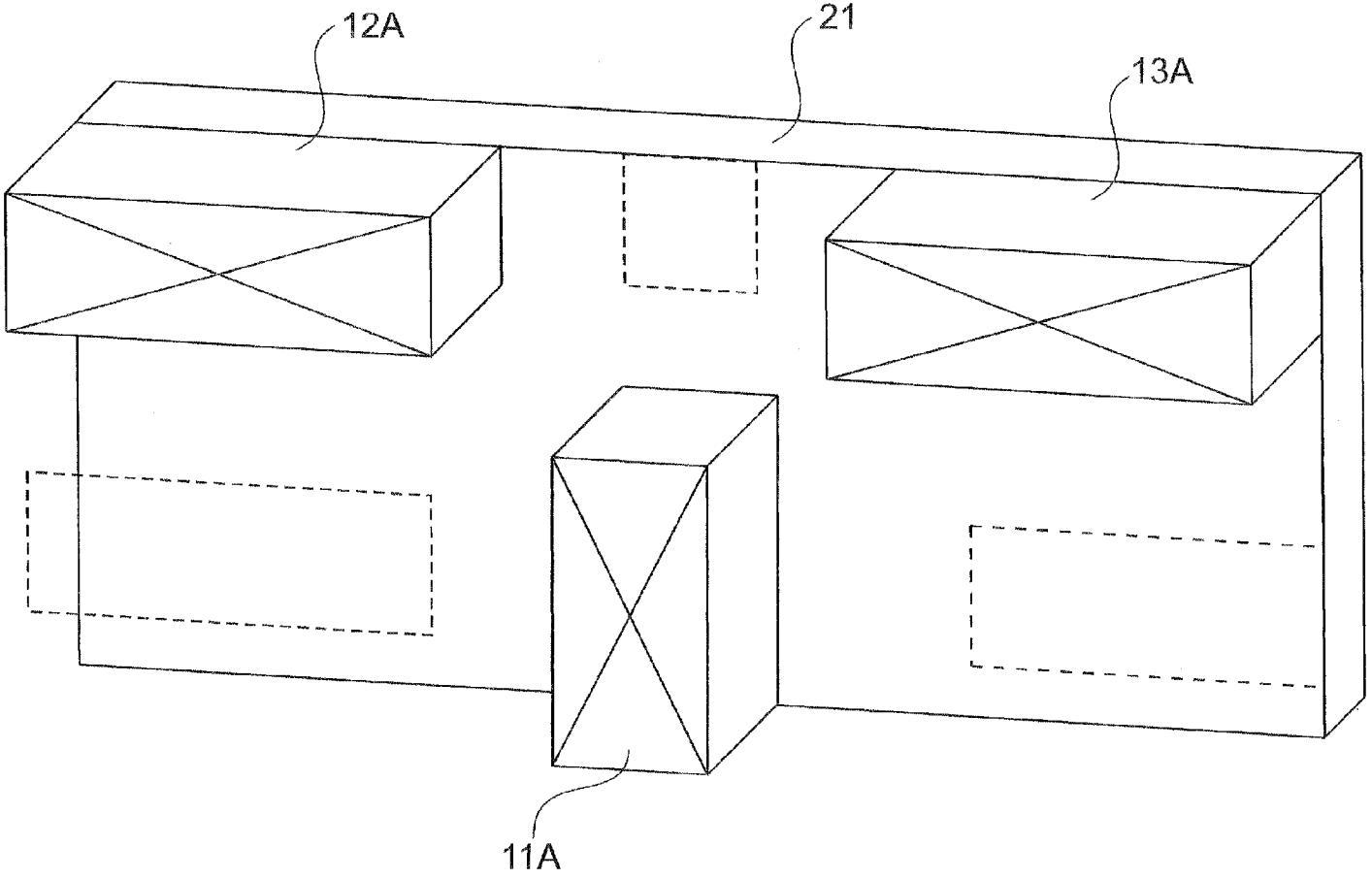
Figure 21:
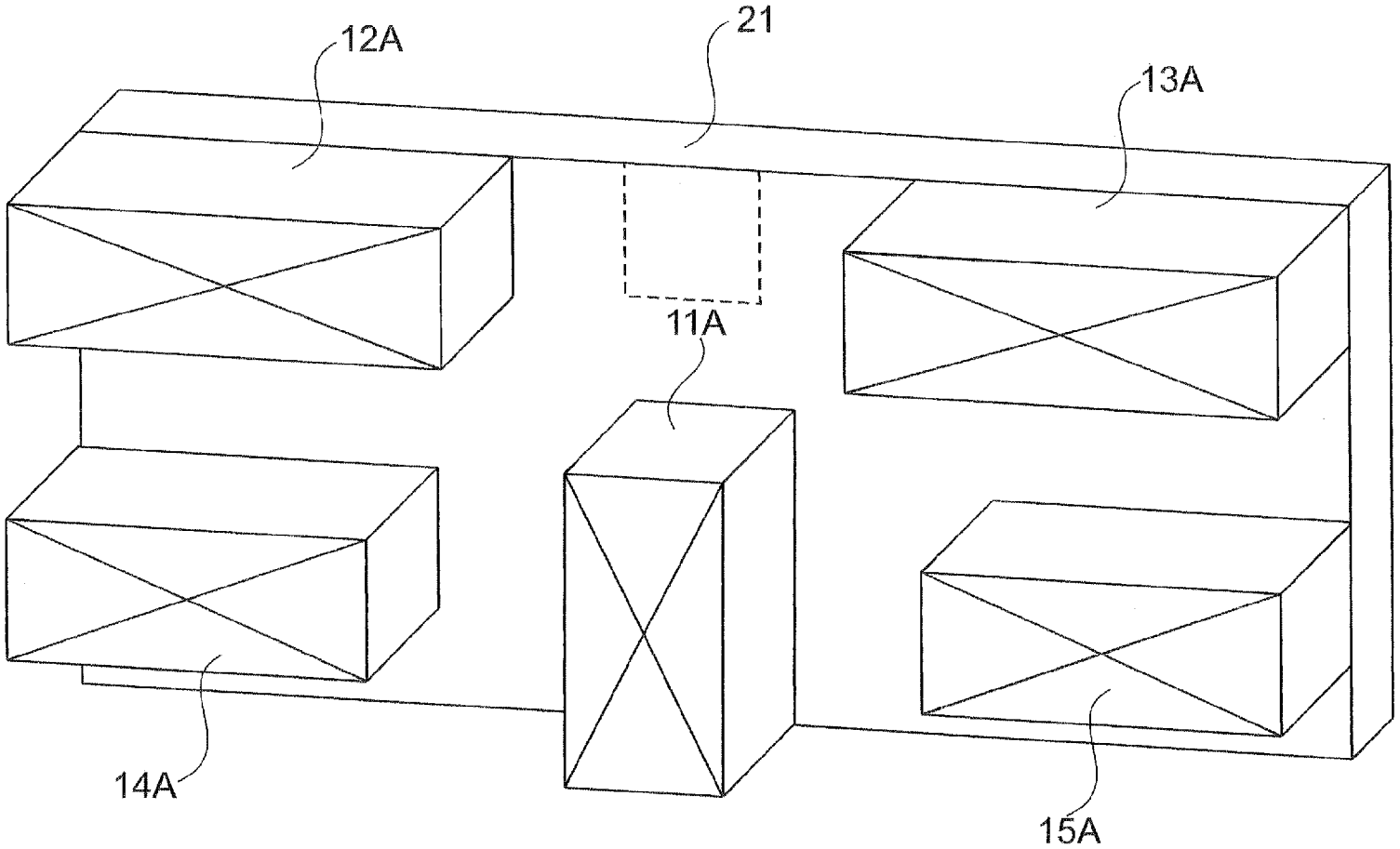

With reference to FIGS. 19, 20, 21, the structure of the device may be simplified according to the variability of the continuous casting process inside the discharger 3. In particular, if the casting conditions are stable, the device may compromise only electromagnetic brakes 10', 11', 12', 13', 14', 15' actually useful for controlling the flows of liquid metals. This solution advantageously allows to reduce not only the operating costs but also, and above all, the total mass of the device. Thus, in this sense, considering, for example, the casting conditions diagrammatically illustrated in FIG. 6 (i.e. at low speed and low flow rate) the device may only comprise the second electromagnetic brake 11', the third electromagnetic brake 12' and a fourth electromagnetic brake 13', as diagrammatically illustrated in FIG. 19.

Similarly, if the casting process and the conformation of the discharger 3 were accompanied by secondary recirculation speeds 6, 6, according to the conditions diagrammatically illustrated in FIGS. 9 and 10, it would be possible to install on the device only the second electromagnetic brake 11', the third electromagnetic brake 12', the third electromagnetic brake 13', according to the arrangement diagrammatically shown in FIG. 20. In the further case in which the casting process were accompanied by high flow speeds and high waviness of the meniscus 7 (as diagrammatically illustrated in FIG. 8), the device could be simplified by installing the second electromagnetic brake 11', the third electromagnetic brake 12', the fourth electromagnetic brake 13', the fifth electromagnetic brake 14' and the sixth electromagnetic brake 15', and advantageously "renouncing" to the installation of the first electromagnetic brake 10'.

The mentioned FIGS. 19, 20, 21 each indicate a specific configuration of the device provided for a specific casting condition. It is worth specifying that in such figures, the specific configuration of the device is illustrated in simplified manner by means of the first ferromagnetic plate 21 and a pole 10A, 11A, 12A, 13A, 14A, 15A of each electromagnet 10', 11', 12', 13', 14', 15' arranged on such first ferromagnetic plate. In such figures, the rectangles drawn with a dashed line have the purpose of indicating the electromagnets which are "not installed" with respect to the six electromagnet configuration shown, for example, in FIG. 13.

The process according to the invention allows to fully fulfill the predetermined tasks and objects. In particular, the presence of a plurality of braking zones which may be activated/deactivated either independently or in groups advantageously allows to control the distribution of flows within the bath under any fluid-dynamic condition which occurs during the casting process. Including differentiated braking zones, the process is advantageously flexible, reliable and easy to be implemented.

Finally, it is worth mentioning that the device for controlling the flows of metal in the crystallizer 1 according to the present invention allows not only the simultaneous activation of several braking zones but also the activation of single braking zones.

The invention claimed is:

1. A process for controlling the flows of liquid metal in a continuous casting of thin slabs, wherein there are provided:

a crystallizer (1) comprising perimetral walls (16, 16', 17, 18), which define a containment volume for a liquid metal bath (4);

a discharger (3), having an outlet section (27), centrally arranged in said bath (4) to discharge said liquid metal;

a first electromagnetic brake (11') for generating a first braking zone (11) in a central portion (41) of said bath (4) in a position under said outlet section (27) of said discharger (3);

a second electromagnetic brake (12') for generating a second braking zone (12) in a first side portion (42) of said bath (4) between said central portion (41) and a first perimetral sidewall (17) substantially orthogonal to front walls (16,16');

a third electromagnetic brake (13') for generating a third braking zone (13) within second side portion (43) of said bath (4), which is symmetric to said first side portion (42) of said bath (4) with respect to a symmetry plane (A-A) substantially orthogonal to said front walls (16, 16');

a fourth electromagnetic brake (14') for generating a braking zone (14) in said first side portion (42) of said bath (4) in a position underneath said second braking zone (12);

a fifth electromagnetic brake (15') for generating a fifth braking zone (15) in said second side portion (43) of said bath (4) in a position underneath said third braking zone (13);

wherein each of said electromagnetic brakes comprises a pair of magnetic poles symmetrically arranged with respect to symmetry plane of said crystallizer, which is substantially parallel to opposite front walls of said crystallizer, each magnetic pole comprising a core and a respective coil supplied by direct current, said core of each magnetic pole being physically independent from the cores of the other electromagnetic brakes, said magnetic poles being configured, so as to generate a magnetic field which crosses said bath according to directions substantially orthogonal to said front walls of said crystallizer, said apparatus comprising a pair of reinforcing walls, each externally adjacent to one of said front walls of said crystallizer, said apparatus comprising a pair of ferromagnetic plates each arranged parallel to one of said reinforcing walls so that the magnetic poles, arranged on a same side with respect to said symmetry plane are comprised between one of said reinforcing walls and one of said ferromagnetic plates wherein said process includes activating said braking zones (10, 11, 12, 13, 14, 15) either independently or in groups according to characteristic parameters, of the fluid-dynamic conditions of said liquid metal in said bath (4).

2. A process according to claim 1, wherein the activation of the braking zones (12, 14, 13, 15) located in a first of the side portions (43, 42) of said bath (4) is provided if the flow rate of liquid metal directed towards the first of the side portions (43, 42) is higher than the flow rate directed towards a second of the side portions (42, 43).

3. A process according to claim 2 wherein the braking zones (13, 15) related to the side portion (43) with the highest flow rate of liquid metal are activated so as to develop a higher braking action with respect to the braking zones (12, 14) related to the other side portion (42) with the lowest flow rate.

4. A process according to claim 1, wherein the activation of the braking zones (12, 14, 13, 15) related to the side portions (43, 42) of said bath (4) is provided when the speed and waviness of said liquid metal in proximity of a surface (7) of said bath (4) exceed a predetermined reference value, said second braking zone (12) and said third braking zone (13) being activated so as to develop a higher braking action with respect to said fourth braking zone (14) and said fifth braking zone (15).

5. A process according to claim 4, wherein the activation of said first braking zone (11) is provided.

6. A process according to claim 1, wherein the second braking zone (12) and the third braking zone (13) are activated when the speeds (V) at a meniscus of said bath (4) are higher than a predetermined value.

7. A process according to claim 6, wherein the activation of said first braking zone (11) is provided.

8. A process according to claim 1, wherein said fourth braking zone (14) and said fifth braking zone (15) are activated when the flow rate of liquid metal in the central portion (41) of said bath (4) exceeds a predetermined value.

9. A process according to claim 8, wherein also the first braking zone (11) is activated.

10. A process according to claim 1, wherein it is provided the activation:

of a group of braking zones (12, 14) activatable in said first side portion (42) of said bath (4); and/or of a group of braking zones (13, 15) activatable in said second side portion (43) of said bath (4).

11. A continuous casting apparatus for thin slabs comprising:

a crystallizer (1);

a discharger (3), having an outlet section (27), adapted to discharge liquid metal into said crystallizer (1), a device for controlling the flows of liquid metal in said crystallizer (1), said device comprising a plurality of electromagnetic brakes (11', 12', 13', 14', 15'), each of which is activatable to generate a corresponding braking zone (11, 12, 13, 14, 15) in a liquid metal bath delimited by two front walls (16, 16') of said crystallizer (1) which are opposite to each other, and by two sidewalls (17, 18) of said crystallizer (1), which are opposite to each other and orthogonal to said front walls (16,16'), wherein each of said electromagnetic brakes (11',12',13',14',15') comprises a pair of magnetic poles symmetrically arranged with respect to a symmetry plane (B-B) of said crystallizer (1), which is substantially parallel to said front walls (16,16') of said crystallizer, each magnetic pole comprising a core and a respective coil supplied by direct current, said core of each of magnetic pole being physically independent from the cores of the other electromagnetic brakes, said magnetic poles being configured so as to generate a magnetic field which cross said bath (4) according to directions substantially orthogonal to said front walls (16, 16') of said crystallizer (1), wherein said apparatus comprises a pair of reinforcing walls (20,20'), each externally adjacent to one of said front walls (16,16') of said crystallizer, said apparatus comprising a pair of ferromagnetic plates (21,21') each arranged parallel to one of said reinforcing walls (20,20') so that the magnetic poles, arranged on a same side with respect to said symmetry plane (B-B) are comprised between one of said reinforcing walls (20,20') and one of said ferromagnetic plates (21, 21')

and wherein:

a first electromagnetic brake (11'), if activated, generates a first braking zone (11) in said central portion (41) of said bath (4) in a position under said outlet section (27) of said discharger (3)

a second electromagnetic brake (12'), if activated, generates a second braking zone (12) in a first side portion (42) of said bath (4) between a central portion (41) and a first perimetral sidewall (17) substantially comprised between said front walls (16,16');

a third electromagnetic brake (13'), if activated, generates a third braking zone (13) within a second side portion (43) of said bath (4) which is symmetric to said first central portion (41) of said bath (4) with respect to a symmetry plane (A-A) substantially orthogonal to said front walls (16, 16');

a fourth electromagnetic brake (14'), if activated, generates a fourth braking zone (14) in said first side portion (42) of said bath (4) in a position underneath said second braking zone (12);

a fifth electromagnetic brake (15'), if activated, generates a fifth braking zone (15) in said second side portion (43) of said bath (4) in a position underneath said third braking zone (13).

* * * * *